US010486224B2

(12) United States Patent
Lee et al.

(10) Patent No.: US 10,486,224 B2
(45) Date of Patent: Nov. 26, 2019

(54) SALTCORE FOR DIE-CASTING WITH ALUMINUM AND MANUFACTURING METHOD THEREFOR

(71) Applicant: Hyundai Motor Company, Seoul (KR)

(72) Inventors: Ji-Yong Lee, Seoul (KR); Cheol-Ung Lee, Busan (KR)

(73) Assignee: Hyundai Motor Company, Seoul (KR)

( * ) Notice: Subject to any disclaimer, the term of this patent is extended or adjusted under 35 U.S.C. 154(b) by 53 days.

(21) Appl. No.: 15/582,293

(22) Filed: Apr. 28, 2017

(65) Prior Publication Data

US 2018/0178271 A1 Jun. 28, 2018

(30) Foreign Application Priority Data

Dec. 23, 2016 (KR) ..... 10-2016-0178205

(51) Int. Cl.

| | |
|---|---|
| ***B22C 1/08*** | (2006.01) |
| ***B22C 9/10*** | (2006.01) |
| ***B22C 1/00*** | (2006.01) |

(52) U.S. Cl.

CPC ..... *B22C 1/08* (2013.01); *B22C 1/00* (2013.01); *B22C 9/105* (2013.01)

(58) Field of Classification Search

CPC .. B22C 9/10; B22C 9/105; B22C 1/00; B22C 1/08

USPC ..... 164/369

See application file for complete search history.

(56) References Cited

U.S. PATENT DOCUMENTS

| | | | | |
|---|---|---|---|---|
| 2009/0288797 | A1* | 11/2009 | Yaokawa et al. ..... | B22C 9/105 164/271 |
| 2010/0247700 | A1* | 9/2010 | Hayashi et al. ..... | B22C 9/04 425/176 |
| 2011/0139309 | A1 | 6/2011 | Showman et al. | |
| 2015/0060005 | A1 | 3/2015 | Hartig | |

FOREIGN PATENT DOCUMENTS

| | | | |
|---|---|---|---|
| EP | 1 674 173 | A1 | 6/2006 |
| EP | 2 277 644 | A1 | 1/2011 |
| JP | S48-39696 | B1 | 11/1973 |
| JP | 5419549 | B2 | 2/2014 |
| JP | 5874735 | B2 | 3/2016 |
| KR | 2000-0006623 | A | 2/2000 |
| KR | 10-2007-0006361 | A | 1/2007 |
| KR | 10-0683969 | B1 | 2/2007 |

OTHER PUBLICATIONS

Jun Yaokawa et al., "Mechanical Properties of Salt Core Comprised of Alkali Carbonate and Alkali Chloride," Chuzo Kogaku—Journal of Japan Foundry Engineering Soc, Nihon Chuzo Kogakukai, Tokyo, Japan, vol. 78, No. 10, Oct. 25, 2006, pp. 516-522.

Jun Yaokawa et al., "Strength of Salt Core Composed of Alkali Carbonate and Alkali Chloride Mixtures Made by Casting Technique," Materials Transactions, vol. 48, No. 5, pp. 1034-1041, Japan Foundry Engineering Society, Apr. 25, 2007.

* cited by examiner

*Primary Examiner* — Kevin P Kerns

(74) *Attorney, Agent, or Firm* — Morgan, Lewis & Bockius LLP

(57) ABSTRACT

Provided herein are a saltcore for casting with aluminum and a manufacturing method thereof, and more particularly, a saltcore and a manufacturing method thereof capable of reducing shrinkage while satisfying strength during die-casting by including at least one cation of $K^+$, $Na^+$ and $Mg^{2+}$ and at least one anion of $Cl^-$ and $CO_3^{2-}$, wherein a saltcore for casting with aluminum may include at least one cation of $K^+$, $Na^+$ and $Mg^{2+}$ and at least one anion of $Cl^-$ and $CO_3^{2-}$.

9 Claims, 31 Drawing Sheets

SALTCORE FOR DIE-CASTING WITH ALUMINUM AND MANUFACTURING METHOD THEREFOR

CROSS-REFERENCE TO RELATED APPLICATIONS

The present application claims priority under 35 U.S.C. § 119 to Korean Patent Application No. 10-2016-0178205, filed on Dec. 23, 2016, the entire contents of which is incorporated herein for all purposes by this reference in its entirety.

BACKGROUND OF THE INVENTION

Field of the Invention

The present invention relates to a saltcore for die-casting with aluminum and a manufacturing method thereof, and more particularly, to a saltcore and a manufacturing method thereof capable of reducing shrinkage while satisfying strength during casting by including at least one cation of $K^+$, $Na^+$ and $Mg^{2+}$ and at least one anion of and $CO_3^{2-}$.

Description of Related Art

A casting process uses the flow of a liquid and is a kind of material processing method of putting a molten metal material into a prepared mold and filling and coagulating the mold, and various methods have been used according to a shape and an injection method of the mold.

Such a casting process has an advantage of forming a complex shape by using a meltable material in only one step. The casting process consists of a mold manufacturing process, a melting process, an injection process, a mold separation process, and the like. In the mold manufacturing process, the mold needs to have a shape and a size appropriate for a desired casting so as to be manufactured and have a proper margin for shrinkage of a solidifying material. In the melting process, the metal is heated at the appropriate temperature to form a liquid, and then a hydrogen gas furnace in the molten metal needs to be removed. The injection process needs to be designed to prevent the solidification shrinkage during solidification while minimizing generation of eddy current during injection. Thereafter, the mold is separated, and after separation, the casting process is finished through the processes of cutting, washing, heating and inspecting an injection port and a spout hole.

On the other hand, a shape (material) inserted into the mold to form the internal shape of the casting is called a core. The core is used for manufacturing a hollow product and the core needs to have sufficient mechanical strength to withstand heat and pressure of the molten metal and maintain the shape during casting, and simultaneously, needs to be relatively easily broken or dissolved into other materials to be easily removed from the cast article after die-casting.

Sand or thermosetting resin is generally used as a material of such a core. In the case of method of using the sand, that is, a sand core, the sand forms the core with a binder, and after casting a desired structure around the core, the binder and the sand that support the core are removed. In the case of a method using the thermosetting resin, a foam is used as a material of the core. However, methods using the sand or the thermosetting resin have been pointed out to cause environmental problems. Furthermore, in the case of the sand core, there is a problem that the sand core may not be realized when a reverse gradient shape exists in the cast article. In order to solve the problems, the material of the core used for casting is made of salt, but in the case where a saltcore in the related art is used for aluminum casting, there is a problem in that the strength to withstand the impact of molten aluminum is insufficient or the shape of the cast article is deformed due to shrinkage of the saltcore during casting.

In order to solve the above-mentioned problems, the present invention proposes a saltcore for aluminum casting capable of reducing the shrinkage while maintaining the strength of the saltcore in the aluminum casting process, and a manufacturing method thereof.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a saltcore for casting with aluminum capable of reducing shrinkage of the saltcore while satisfying strength (providing desired strength) during casting with aluminum.

Various aspects of the present invention are directed to providing a manufacturing method of the saltcore for casting with aluminum capable of reducing manufacturing costs by reducing the defect rate while improving the dimensional accuracy of the manufactured aluminum cast article. Also, manufacturing costs are reduced by the reduced shrinkage of the saltcore.

Technical objects desired to be achieved in an exemplary embodiment of the present invention are not limited to the aforementioned technical objects, and other technical objects not described above will be apparent to those skilled in the art from the disclosure of the present invention.

An exemplary embodiment of the present invention are directed to providing a saltcore for casting with aluminum including at least one cation of $K^+$, $Na^+$ and $Mg^{2+}$ and at least one anion of $Cl^-$ and $CO_3^{2-}$.

The $K^+$ may be 35 to 40 mol %, the $Na^+$ may be 110 to 130 mol %, and the $Mg^{2+}$ may be more than 0 mol % and less than 1 mol %, the may be more than 35 mol % and less than 42 mol %, and the $CO_3^{2-}$ may be 55 to 65 mol %.

The $K^+$ or $Mg^{2+}$ may be bonded to the $Cl^-$, and the $Na^+$ may be bonded to the $CO_3^{2-}$.

The KCl may be 35 to 40 mol %, the $Na_2CO_3$ may be 55 to 65 mol %, and the $MgCl_2$ may be more than 0 mol % and less than 1 mol %.

Another exemplary embodiment of the present invention are directed to providing a saltcore for casting with aluminum including at least one cation of $K^+$ and $Na^+$, at least one anion of $Cl^-$ and $CO_3^{2-}$, and dolomite.

The $K^+$ may be 35 to 40 mol % or the $Na^+$ may be 110 to 130 mol %, and the $Cl^-$ may be 35 to 40 mol % or the $CO_3^{2-}$ may be 55 to 65 mol %, and the dolomite may be more than 0 wt % and less than 1 wt % with respect to the total weight.

The $K^+$ may be bonded to the $Cl^-$, and the $Na^+$ may be bonded to the $CO_3^{2-}$.

The KCl may be 35 to 40 mol %, the $Na_2CO_3$ may be 55 to 65 mol %, and the dolomite may be more than 0 wt % and less than 1 wt % with respect to the entire weight.

Yet another exemplary embodiment of the present invention are directed to providing a method for manufacturing a saltcore for casting with aluminum including: a mixing step of mixing and forming a mixture containing components of the saltcore for casting with aluminum; a melting step of forming a molten salt by melting the mixture containing components of the saltcore; a heating step of heating the molten salt by a caster; and an injecting step of injecting the heated molten salt into the mold by the caster.

In the melting step, the molten salt may be molten by using an electric furnace.

The temperature of the melting step may be 700 to 800° C.

The caster in the heating step may be a low-pressure caster or a high-pressure caster.

According to the saltcore for casting with aluminum of the present invention, it is possible to provide a saltcore for casting with aluminum which reduces shrinkage of the saltcore while satisfying the strength when casting aluminum.

According to the method for manufacturing the saltcore for casting with aluminum of the present invention, it is possible to provide a saltcore for casting with aluminum which reduces manufacturing costs by reducing a defect rate while improving the dimensional accuracy of an aluminum cast article, by applying the saltcore for casting with aluminum reducing shrinkage.

Figure 1:
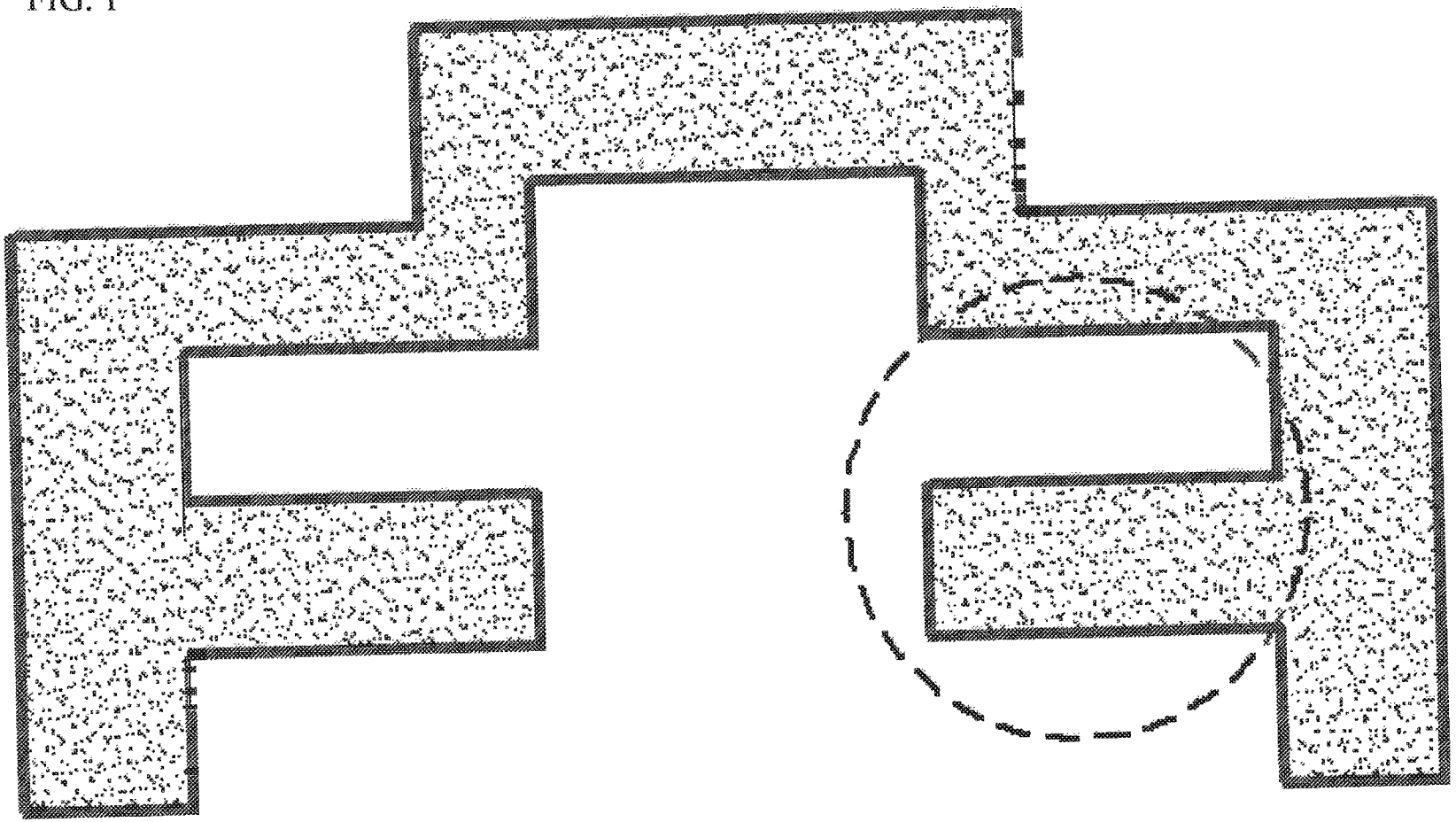
FIG. 1 is a cross-sectional configuration diagram of a cast article in the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An aspect of the present invention relates to a manufacturing method for a saltcore for casting with aluminum.

Generally, a manufacturing method which is the most widely used among methods for manufacturing an aluminum component for a vehicle is a high-pressure casting method. The high-pressure casting method has an advantage of shortening a manufacturing time and improving productivity by injecting molten aluminum into a mold at high pressure. Specifically, as compared with a gravity casting method and a low-pressure casting method in the related art, the high-pressure casting method has high productivity because a cycle time of producing the cast article is about 10% to largely reduce the cost.

FIG. 1 is a cross-sectional configuration diagram of a cast article 5 in the related art. In FIG. 1, it may be verified that an undercut shape exists in the cast article. However, in the case of high-pressure casting, when an inner complicated flow path and the undercut shape (reverse gradient) illustrated in FIG. 1 are present, it is difficult to manufacture the undercut shape by a high-pressure casting method, and thus, there has been a problem in that a gravity casting method capable of forming an inner undercut shape by using the sand core 11 having low productivity cannot be used.

When the sand core 11 is used in the high-pressure casting process, there is a problem in that when the cast article is manufactured, molten aluminum 1 that is injected into the mold is collapsed without withstanding the high pressure. Accordingly, the present invention provides a core for casting with aluminum in which a cast article may be easily removed after being manufactured while withstanding the pressure of molten aluminum injected into a mold in the high-pressure casting process.

In order to manufacture a high-strength core for solving the problems of the related art, a variety of salts have been used as materials used for the core.

In detail, the saltcore for casting with aluminum of the present invention relates to a saltcore which applies a method in which one or more various salts are mixed and melted, the molten salt is injected and solidified into the mold used for manufacturing the core so as not to be collapsed at pressure generated when injecting the molten aluminum in the high-pressure casting process, and after the aluminum cast article is cast, the cast article is removed by high-pressure water, that is, water jet.

Figure 2:
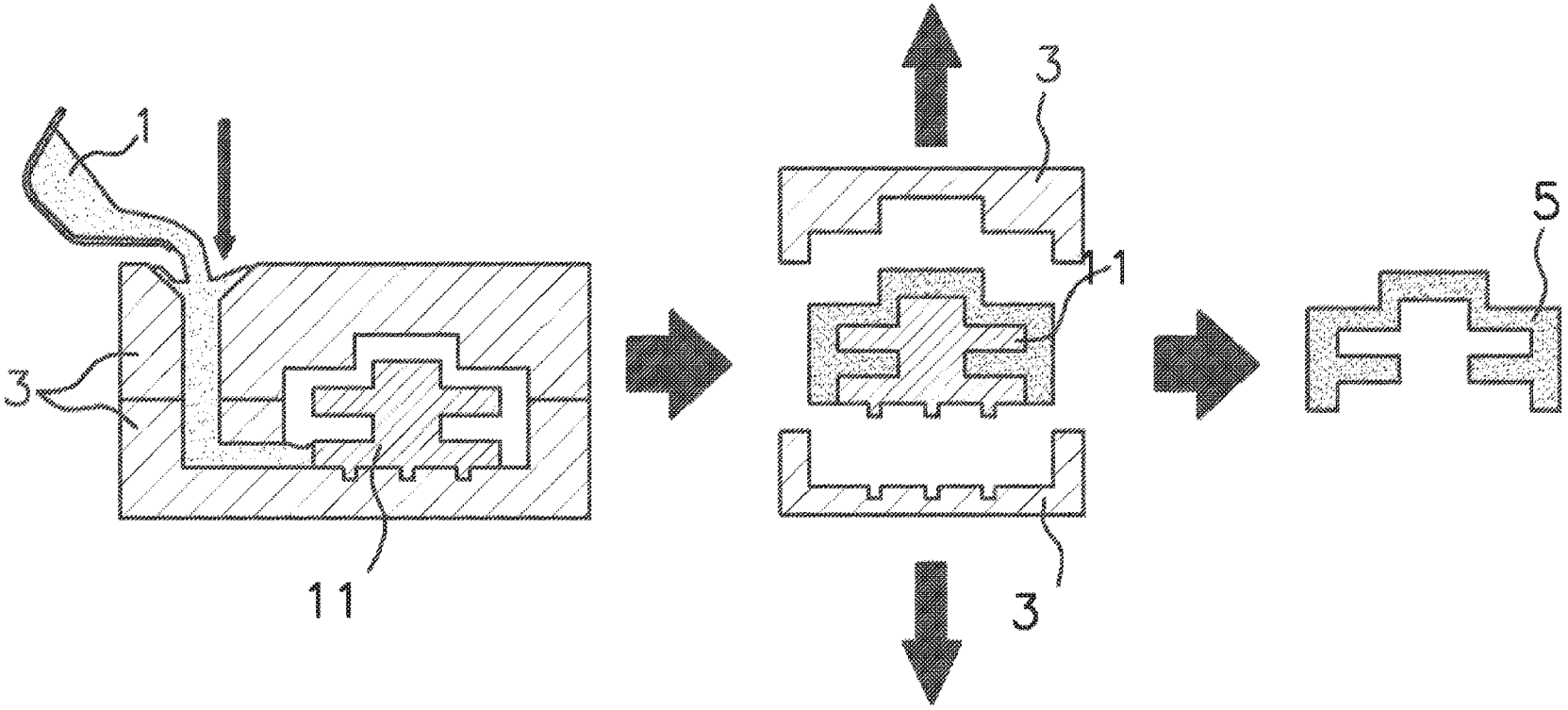
FIG. 2 is a configuration diagram for each step of gravity casting using a sand core in the related art.

FIG. 2 is a configuration diagram for each step of gravity casting using a sand core 11 in the related art. In the related art, in order to manufacture an aluminum cast article including a reverse gradient shape, a gravity casting method is used. Specifically, after the sand core 11 is placed in the mold 3, the molten aluminum 1 is injected into the mold 3 at pressure of about 1 kgf/cm$^2$. Then, when the molten aluminum is solidified, the mold 3 was removed and the sand core 11 contained in the solidified aluminum was removed by mechanical vibration to manufacture an aluminum cast article having a reverse gradient shape. However, the sand core 11 used in the gravity casting method may not be used in the high-pressure casting, and thus there is a problem in that it takes a long time to manufacture the cast article and thus production cost is increased.

To overcome disadvantages of the gravity casting method, a high pressure casting method is applied to the present invention. However, since there is a problem in that the sand core used in the related art does not withstand the pressure generated when casting the molten aluminum in the high pressure casting method, in an exemplary embodiment of the present invention, a saltcore other than the sand core is applied to the high-pressure casting method.

Figure 3:
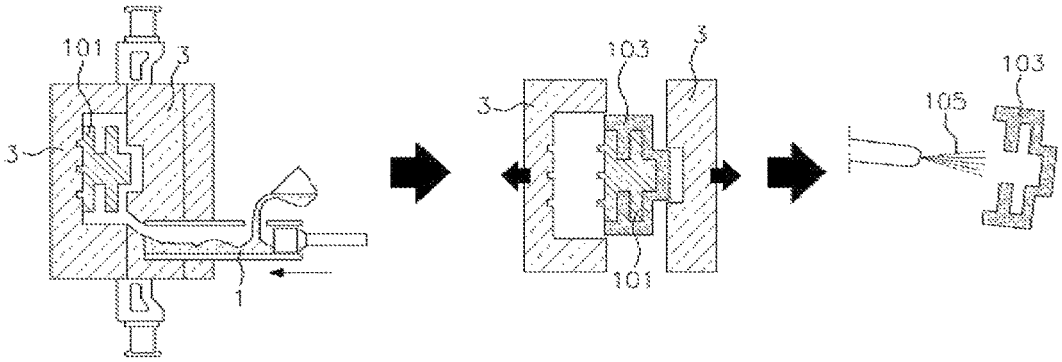
FIG. 3 is a configuration diagram for each step of high-pressure casting using a saltcore according to an exemplary embodiment of the present invention.

FIG. 3 is a configuration diagram for each step of high-pressure casting using a saltcore 101 according to an exemplary embodiment of the present invention. As illustrated in FIG. 3, the saltcore 101 including a reverse gradient shape is positioned in the mold 3 to manufacture the cast article by injecting molten aluminum 1 molten in the mold 3 at high pressure corresponding to about 700 to 900 kgf/cm$^2$. Thereafter, the saltcore 101 is removed by injecting high-pressure water 105 (water jet) to prepare a cast article 103 according to an exemplary embodiment of the present invention. The saltcore 101 may withstand a pressure of at least 20 MPa, and in the case of using the saltcore 101, the saltcore 101 may be cast so as to have a thickness of about 2 mm or less to reduce a size and a weight, and the cycle time is reduced and productivity is high to reduce the cost corresponding to about 10 to 15%.

Manufacturing of the component by a high-pressure casting method using the saltcore of the present invention is constituted by the following two steps. That is, the manufacturing is constituted by manufacturing the saltcore as a first step and manufacturing a component by a high-speed high-pressure casting method using the saltcore as a second step.

Figure 4:
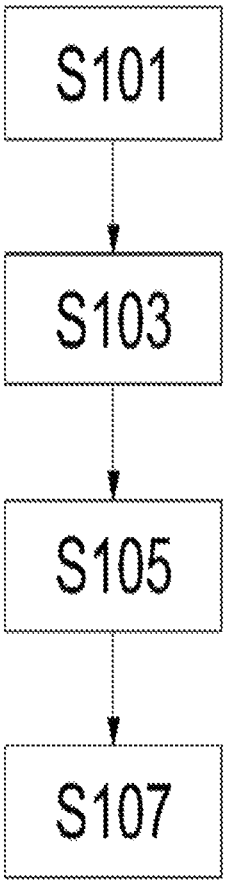
FIG. 4 is a flowchart of a method for manufacturing a saltcore according to another exemplary embodiment of the present invention.

When describing the manufacturing of the saltcore as the first step in detail, FIG. 4 is a flowchart of the method for manufacturing the saltcore according to the exemplary embodiment of the present invention. The method includes a mixing step (S101) of mixing and forming a mixture containing components of the saltcore for casting with aluminum to be described below; a melting step (S103) of forming molten salt by melting the mixture; a heating step (S105) of heating the molten salt by a caster; and an injection step (S107) of injecting the heated molten salt into the mold by the caster. Further, in the melting step (S103), the mixture may be molten by using an electric furnace and the temperature of the melting step (S103) may be about 700 to 800° C. Furthermore, the caster in the heating step (S105) may be a low-pressure caster or a high-pressure caster.

In more detail, after the mixing step (S101) of forming the mixture by uniformly mixing a salt containing components of the saltcore for casting with aluminum to be described below, that is, an industrial salt having a high melting point, the melting step (S103) of melting the salt is performed at about 700 to 800° C. which is a melting point or more of the salt by using the electric furnace. However, the means of melting the salt is not limited to the electric furnace and various means for melting the salt may be applied. After the melting step (S103), the heating step (S105) of heating the molten salt by the low-pressure caster or the high-pressure caster is performed. Thereafter, the injecting step (S107) of injecting the molten salt into the mold at a high speed and a high pressure with the low-pressure caster or the high-pressure caster in which the molten salt is heated is performed. When the molten salt is solidified, the saltcore for casting with aluminum of the present invention is formed.

Figure 5:
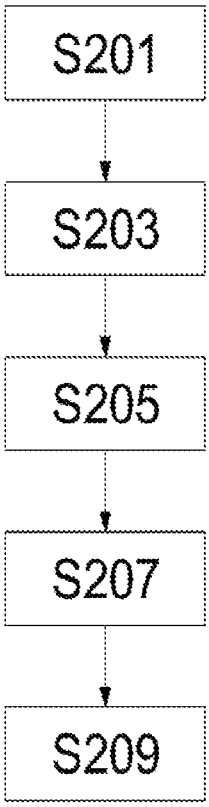
FIG. 5 is a flowchart of a method for manufacturing an aluminum component formed by high-pressure casting by applying the saltcore according to the exemplary embodiment of the present invention.

When describing the manufacturing step of the component by the high-speed and high-pressure casting method applying the saltcore as the second step in detail, FIG. 5 is a flowchart of a method for manufacturing an aluminum component formed by high-pressure casting by applying the saltcore according to the exemplary embodiment of the present invention. The manufacturing of the component by the high-speed and high-pressure casting method applying the saltcore as the second step includes an aluminum melting step (S201) as a first step for forming molten aluminum, a saltcore inserting step (S203) as a second step for placing a saltcore in a mold, a molten aluminum heating step (S205) as a third step of injecting the molten aluminum into a high-pressure caster, a high-pressure casting step (S207) as a fourth step of injecting the molten aluminum into the mold, and a saltcore removing step (S209) as a fifth step of removing the saltcore contained in an aluminum cast article.

In more detail, the molten aluminum is formed by melting aluminum at about 700° C. which is the melting point or more of aluminum. Thereafter, the saltcore manufactured in the first step is inserted and mounted into the mold for casting the aluminum cast article. Thereafter, the molten aluminum is heated in the high-pressure caster and then the molten aluminum is injected into the mold by the high-pressure caster. Thereafter, when the molten aluminum injected into the mold is solidified to form the aluminum cast article including the saltcore, the saltcore is removed using the high-pressure water jet to complete the cast article.

Meanwhile, another aspect of the present invention relates to a saltcore for casting with aluminum. In order to solve the problems of the above-described related art, the present invention provides a saltcore for casting with aluminum including at least one cation selected from $K^+$, $Na^+$ and $Mg^{2+}$ and at least one anion selected from $Cl^-$ and $CO_3^{2-}$. Further, the $K^+$ is about 35 to 40 mol % (e.g., about 35 mol %, 36, 37, 38, 39, or about 40 mol %), the $Na^+$ is about 110 to 130 mol % (e.g., about 110 mol %, 111, 112, 113, 114, 115, 116, 117, 118, 119, 120, 121, 122, 123, 124, 125, 126, 127, 128, 129, or about 130 mol %), and the $Mg^{2+}$ is about more than 0 mol % and less than 1 mol % (e.g, about more than 0 mol %, about 0.1 mol %, 0.2, 0.3, 0.4, 0.5, 0.6, 0.7, 0.8, 0.9, or about less than 1 mol %), the $Cl^-$ is about more than 35 mol % and less than 42 mol % (e.g., about more than 35 mol %, about 36 mol %, 37, 38, 39, 40, 41, or about less than 42 mol %), the $CO_3^{2-}$ may be about 55 and 65 mol % (e.g., about 55 mol %, 56, 57, 58, 59, 60, 61, 62, 63, 64, or about 65 mol %), and the $K^+$ or $Mg^{2+}$ may be bonded to the $Cl^-$, and the $Na^+$ may be bonded to the $CO_3^{2-}$. Furthermore, the KCl may be about 35 to 40 mol % (e.g., about 35 mol %, 36, 37,38, 39, or about 40 mol %), the $Na_2CO_3$ may be about 55 to 65 mol % (e.g., about 55 mol %, 56, 57, 58, 59, 60, 61, 62, 63, 64, or about 65 mol %), and the $MgCl_2$ may be about more than 0 mol % and less than 1 mol % (e.g, about more than 0 mol %, about 0.1 mol %, 0.2, 0.3, 0.4, 0.5, 0.6, 0.7, 0.8, 0.9, or about less than 1 mol %).

In order to solve the above-described related art, the present invention provides a saltcore for casting with aluminum including at least one cation of $K^+$, $Na^+$ and $Mg^{2+}$, at least one anion of $Cl^-$ and $CO_3^{2-}$, and dolomite. Furthermore, the $K^+$ is about 35 to 40 mol % (e.g., about 35 mol %, 36, 37, 38, 39, or about 40 mol %) or the $Na^+$ is about 110 to 130 mol % (e.g., about 110 mol %, 111, 112, 113, 114, 115, 116, 117, 118, 119, 120, 121, 122, 123, 124, 125, 126, 127, 128, 129, or about 130 mol %), and the $Cl^-$ is about 35 to 40 mol % (e.g., about 35 mol %, 36, 37, 38, 39, or about 40 mol %) or the $CO_3^{2-}$ is about 55 to 65 mol % (e.g., about 55 mol %, 56, 57, 58, 59, 60, 61, 62, 63, 64, or about 65 mol %), and the dolomite may be about more than 0 wt % and less than 1 wt % (e.g., about more than 0 wt %, about 0.1, 0.2, 0.3, 0.4, 0.5, 0.6, 0.7, 0.8, 0.9, or about less than 1 wt %) with respect to the entire weight, and the $K^+$ may be bonded to the $Cl^-$, and the $Na^+$ may be bonded to the $CO_3^{2-}$. Further, the KCl may be about 35 to 40 mol % (e.g., about 35 mol %, 36, 37, 38, 39, or about 40 mol %), the $Na_2CO_3$ may be about 55 to 65 mol % (e.g., about 55 mol %, 56, 57, 58, 59, 60, 61, 62, 63, 64, or about 65 mol %), and the dolomite may be about more than 0 wt % and less than 1 wt % (e.g., about more than 0 wt %, about 0.1, 0.2, 0.3, 0.4, 0.5, 0.6, 0.7, 0.8, 0.9, or about less than 1 wt %) with respect to the total weight.

Meanwhile, in the related art, there are problems in that the saltcore is broken by the injection pressure of the molten aluminum during the high-pressure casting and the aluminum cast article is deformed by excessive shrinkage in the process of solidifying the molten aluminum. Therefore, the saltcore for casting with aluminum of the present invention not only improves the strength but also reduces the shrinkage of the saltcore, thereby reducing the occurrence of deformation of the aluminum cast article.

The sand core in the related art has the strength of about 3 to 5 MPa and has a problem that the sand core may not withstand the pressure at which the molten metal is injected during high-pressure casting. Therefore, in order to withstand the pressure at which the molten metal is injected during high-pressure casting, the strength of at least about 15 MPa needs to be satisfied. In addition, the shrinkage of the saltcore is required to be about 1.2% or less, which is similar to the shrinkage of aluminum because the cast article to be cast by inserting the saltcore uses aluminum.

Figure 6:
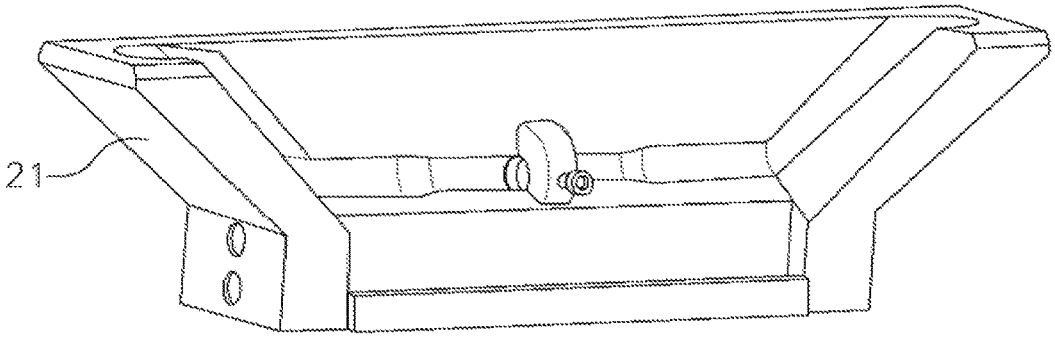
FIG. 6 is a configuration diagram of a mold for manufacturing a saltcore specimen for measuring strength according to the exemplary embodiment of the present invention and the related art.
Figure 7:
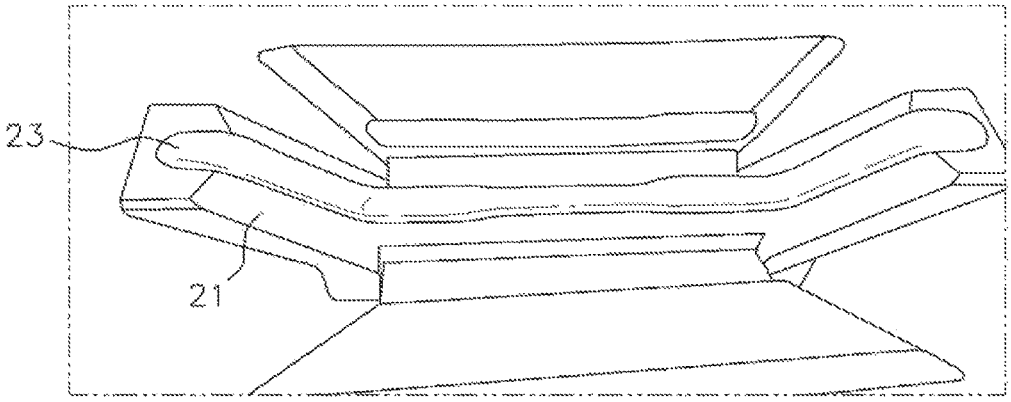
FIG. 7 is a photograph of the saltcore specimen for measuring strength.
Figure 8:
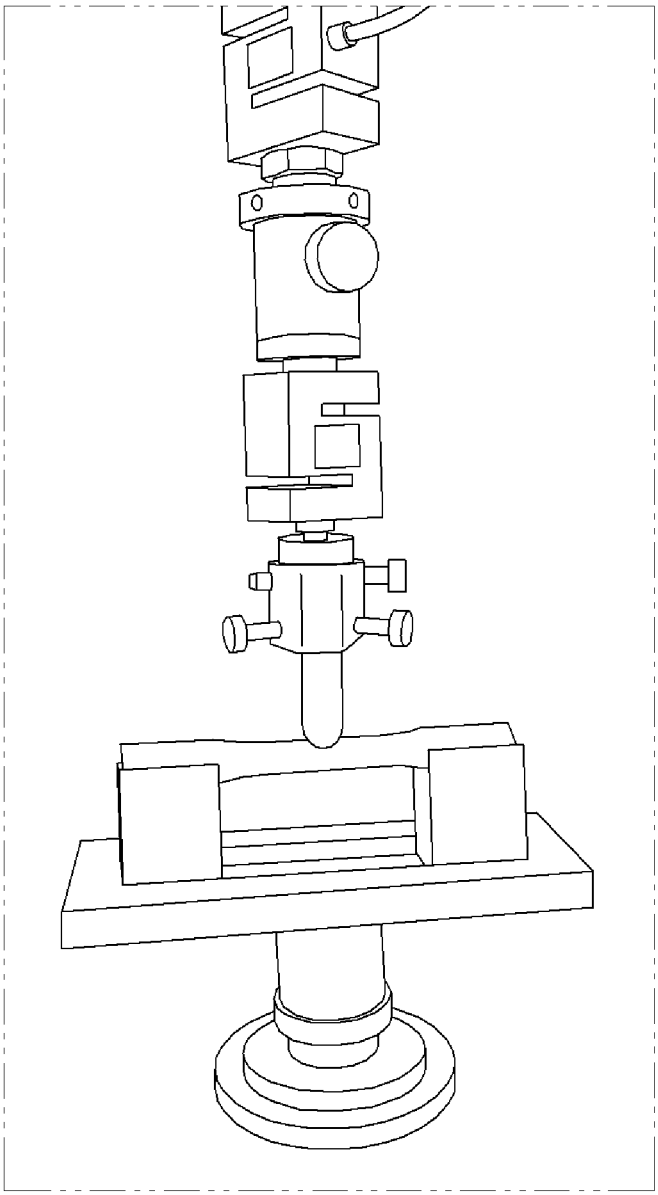
FIG. 8 is a photograph of a device for measuring the strength of the saltcore.

As a result, in order to develop the saltcore satisfying the conditions, a method for evaluating the strength and the shrinkage of the saltcore will be described. When describing a method of measuring the strength of the saltcore in detail, FIG. 6 is a configuration diagram of a mold 21 for manufacturing a saltcore specimen for measuring strength according to the exemplary embodiment of the present invention and the related art. As illustrated in FIG. 6, a saltcore specimen (23) for measuring the strength is prepared using a mold (Diez-die) for preparing a saltcore specimen for measuring the strength. FIG. 7 is a photograph of the saltcore specimen 23 for measuring the strength. The saltcore specimen 23 for measuring the strength made by using the mold 21 for preparing the saltcore specimen for measuring the strength in FIG. 6 is illustrated in FIG. 7. FIG. 8 is a photograph of a device for measuring the strength of the saltcore. The strength of the saltcore specimen for measuring the strength in the related art and the strength of the saltcore specimen for measuring the strength of the present invention are measured by using the device illustrated in FIG. 8.

Figure 9:
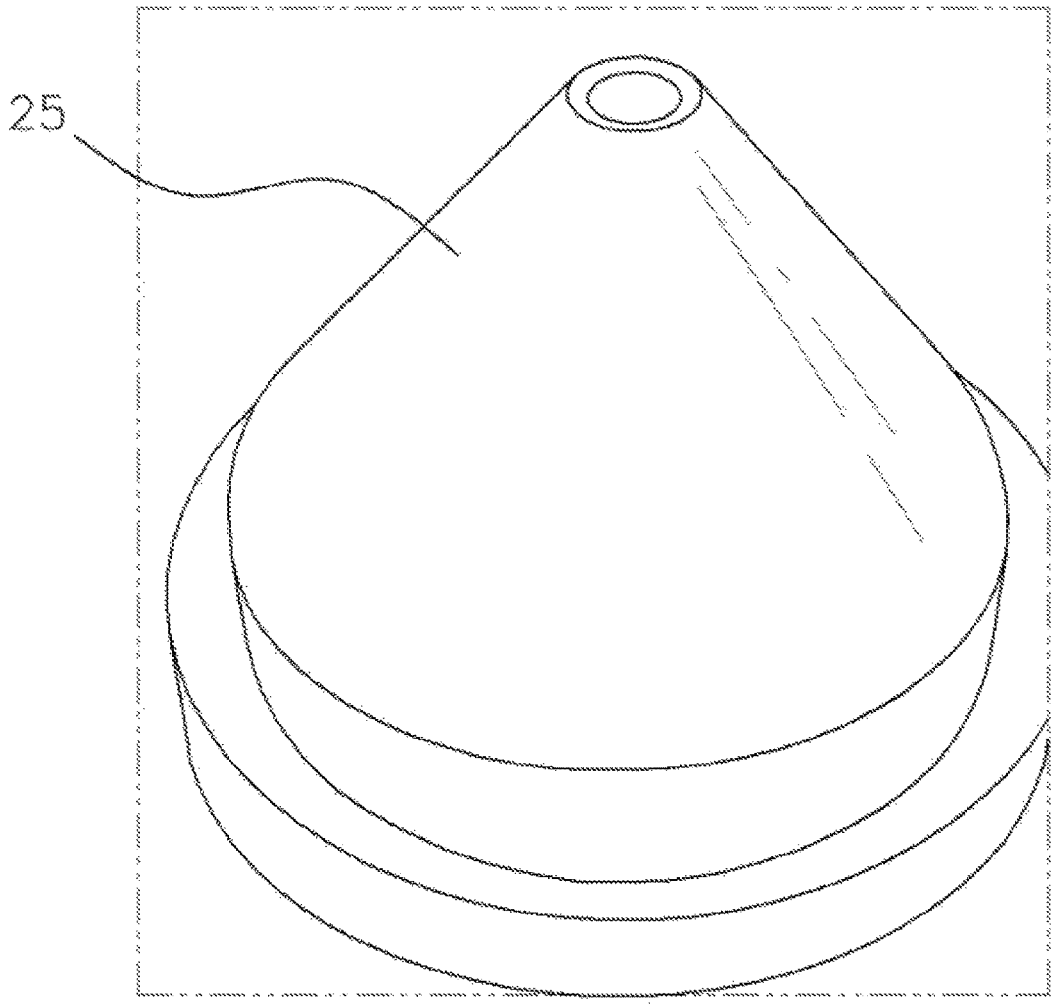
FIG. 9 is a photograph of a saltcore specimen for measuring shrinkage.
Figure 10:
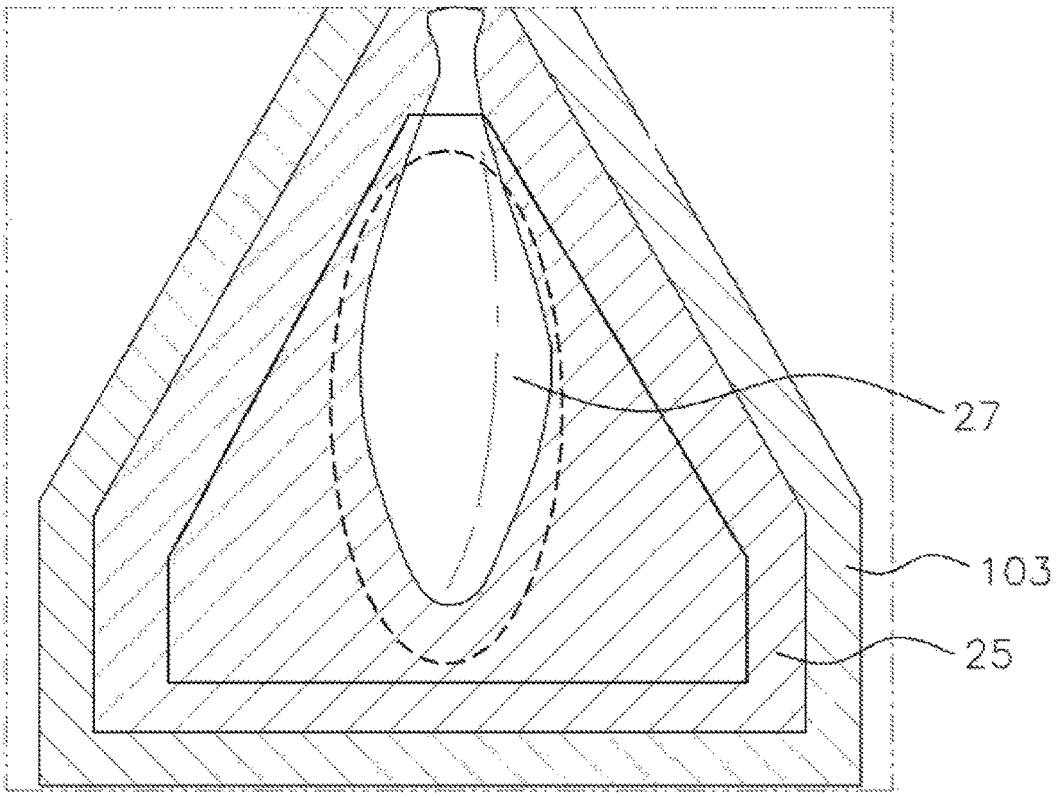
FIG. 10 is a photograph illustrating a cross section of the saltcore specimen for measuring the shrinkage.

When describing the method of measuring the shrinkage of the saltcore in detail, FIG. 9 is a photograph of a saltcore specimen 25 for measuring a shrinkage. In order to evaluate shrinkages of a saltcore specimen for measuring the shrinkage in the related art and a saltcore specimen for measuring the shrinkage of the present invention, a saltcore specimen (a Tatur sample) for measuring the shrinkage having a shape illustrated in FIG. 9 is prepared. FIG. 10 is a photograph illustrating a cross section of the saltcore specimen 25 for measuring the shrinkage. FIG. 10 is a cross section of the aluminum cast article including the saltcore specimen 25 for measuring the shrinkage and it may be verified that an inner space 27 of the saltcore specimen for measuring the shrinkage is formed.

$$\text{Solidification shrinkage (\%)} = V_{\text{inner space of saltcore specimen for measuring shrinkage}} / V_{\text{saltcore specimen for measuring shrinkage}} \quad \text{[Equation 1]}$$

Equation 1 illustrates a solidification shrinkage (micro shrinkage) and corresponds to a value obtained by dividing a cavity of the inner space of the saltcore specimen for measuring the shrinkage by a cavity of the saltcore specimen for measuring the shrinkage. More particularly, the solidification shrinkage corresponds to an index capable of verifying a difference in shrinkage according to a difference of the saltcore, which is obtained by dividing a cavity generated when the inner space of the saltcore specimen is shrunk is divided by the cavity of the entire mold. That is, the solidification shrinkage may be referred to as a kind of inner shrinkage.

$$\text{Shrinkage (\%)}=(V_{saltcore\ specimen\ for\ measuring\ shrinkage}-V_{salt})/V_{saltcore\ specimen\ for\ measuring\ shrinkage} \quad \text{[Equation 2]}$$

Equation 2 is a value obtained by dividing a difference value between the cavity of the saltcore specimen for measuring the shrinkage and a cavity of the salt by the cavity of the saltcore specimen for measuring the shrinkage and corresponds to a shrinkage. Equation 2 corresponds to an index representing whether a dimension of the mold coincides with a dimension of the saltcore and in order to apply the saltcore of the present invention, in addition to the inner shrinkage, that is, the solidification shrinkage, consistency of an outer dimension of the saltcore also corresponds to an important factor. In addition to the inner shrinkage of Equation 1, consistency of the outer dimensions of the mold and the saltcore corresponds to an important factor for the purpose of not shrinking during casting of the saltcore. Accordingly, the shrinkage (micro shrinkage) is used as a criterion for comparing the shrinkages of the salt cores of the related art and the present invention.

Therefore, the strengths and shrinkages in Comparative Example as the related art and Example as the present invention are measured according to the method and the criteria for evaluating the strength and the shrinkage of the saltcore.

EXAMPLES

Hereinafter, the present invention will be described in more detail through Examples. These Examples are just to exemplify the present invention, and it is apparent to those skilled in the art that it is interpreted that the scope of the present invention is not limited to these Examples.

TABLE 1

| | NaCl | KCl | $Na_2CO_3$ | $CaCl_2$ | $MgCl_2$ | Dolomite |
|---|---|---|---|---|---|---|
| Comparative Example 1 | 40 mol % | X | 60 mol % | X | X | X |
| Comparative Example 2 | 70 mol % | X | 30 mol % | X | X | X |
| Comparative Example 3 | X | 40 mol % | 60 mol % | X | X | X |
| Comparative Example 4 | X | 70 mol % | 30 mol % | X | X | X |
| Comparative Example 5 | 10 mol % | 30 mol % | 60 mol % | X | X | X |
| Comparative Example 6 | 25 mol % | 25 mol % | 50 mol % | X | X | X |
| Comparative Example 7 | 40 mol % | X | X | 60 mol % | X | X |
| Comparative Example 8 | 60 mol % | X | X | 40 mol % | X | X |
| Comparative Example 9 | X | 70 mol % | X | 30 mol % | X | X |
| Comparative Example 10 | X | 80 mol % | X | 20 mol % | X | X |
| Comparative Example 11 | X | X | 10 mol % | 90 mol % | X | X |
| Comparative Example 12 | X | X | 20 mol % | 80 mol % | X | X |
| Comparative Example 13 | X | X | 30 mol % | 70 mol % | X | X |
| Comparative Example 14 | X | X | 40 mol % | 60 mol % | X | X |
| Comparative Example 15 | X | X | 50 mol % | 50 mol % | X | X |
| Comparative Example 16 | X | X | 60 mol % | 40 mol % | X | X |
| Comparative Example 17 | X | 39 mol % | 60 mol % | X | X | 1 wt % |
| Comparative Example 18 | X | 35 mol % | 60 mol % | X | X | 5 wt % |
| Comparative Example 19 | X | 35 mol % | 60 mol % | X | 5 mol % | X |
| Comparative Example 20 | X | 37 mol % | 60 mol % | X | 3 mol % | X |
| Comparative Example 21 | X | 39 mol % | 60 mol % | X | 1 mol % | X |

Table 1 is a table illustrating components in Comparative Examples as the related art. The Comparative Examples 1 and 2 correspond to a saltcore containing only NaCl and $Na_2CO_3$ and have different composition ratios. The Comparative Examples 3 and 4 correspond to a saltcore containing only KCl and $Na_2CO_3$ and have different composition ratios. The Comparative Examples 5 and 6 correspond to a saltcore containing only NaCl, KCl and $Na_2CO_3$ and have different composition ratios. The Comparative Examples 7 and 8 correspond to a saltcore containing only NaCl and $CaCl_2$ and have different composition ratios. The Comparative Examples 9 and 10 correspond to a saltcore containing only KCl and $CaCl_2$ and have different composition ratios. The Comparative Examples 11 to 16 correspond to a saltcore containing only $Na_2CO_3$ and $CaCl_2$ and have different composition ratios. The Comparative Examples 17 and 18 correspond to a saltcore containing KCl, $Na_2CO_3$ and dolomite and have different composition ratios and the composition ratios of the dolomite are 1 wt % and 5 wt % with respect to the entire weight of the saltcore.

TABLE 2

| | NaCl | KCl | $Na_2CO_3$ | $CaCl_2$ | $MgCl_2$ | Dolomite |
|---|---|---|---|---|---|---|
| Example 1 | X | 39.9 mol % | 60 mol % | X | X | 0.1 wt % |
| Example 2 | X | 39.7 mol % | 60 mol % | X | X | 0.3 wt % |
| Example 3 | X | 39.5 mol % | 60 mol % | X | X | 0.5 wt % |

Table 2 is a table illustrating a composition of the saltcore including the dolomite in the saltcore for casting with aluminum of the present invention. Particularly, the Examples 1 to 3 correspond to a saltcore containing KCl, $Na_2CO_3$,and dolomite and have different composition ratios and the composition ratios of the dolomite are 0.1 wt %, 0.3 wt % and 0.5 wt % with respect to the entire weight of the saltcore, respectively.

TABLE 3

| | NaCl | KCl | $Na_2CO_3$ | $CaCl_2$ | $MgCl_2$ | Dolomite |
|---|---|---|---|---|---|---|
| Example 4 | X | 39.5 mol % | 60 mol % | X | 0.5 mol % | X |
| Example 5 | X | 39.7 mol % | 60 mol % | X | 0.3 mol % | X |
| Example 6 | X | 39.9 mol % | 60 mol % | X | 0.1 mol % | X |

Table 3 is a table illustrating a composition of a saltcore including $MgCl_2$ in the saltcore for casting with aluminum of the present invention. Particularly, the Examples 4 to 6 correspond to the saltcore containing KCl, $Na_2CO_3$, and $MgCl_2$ and have different composition ratios and $MgCl_2$ includes 0.1 mol %, 0.3 mol % and 0.5 mol %, respectively.

TABLE 4

| | Strength (MPa) | Shrinkage (%) |
|---|---|---|
| Comparative Example 1 | 19 to 22 | 2.85 |
| Comparative Example 2 | 22 to 27 | 3.96 |
| Comparative Example 3 | 20 to 22 | 2.80 |
| Comparative Example 4 | 11 to 16 | 3.10 |
| Comparative Example 5 | 19 to 23 | 2.60 |
| Comparative Example 6 | 21 to 24 | 3.20 |
| Comparative Example 17 | 21 to 24 | 1.37 |
| Comparative Example 18 | 16 to 19 | 2.26 |
| Comparative Example 19 | 8 to 12 | 3.20 |
| Comparative Example 20 | 13 to 17 | 2.36 |
| Comparative Example 21 | 15 to 19 | 1.30 |
| Example 1 | 15 to 20 | 0.71 |
| Example 2 | 18 to 21 | 0.94 |
| Example 3 | 20 to 24 | 1.17 |
| Example 4 | 15 to 22 | 1.08 |
| Example 5 | 17 to 18 | 0.7 |
| Example 6 | 17 to 19 | 0.8 |

Table 4 illustrates the strengths and the shrinkages in Comparative Examples and Examples. In order to apply a high-pressure casting method in the saltcore for casting with aluminum of the present invention, the strength of the saltcore needs to satisfy about 15 MPa or more. Furthermore, in order to perform high-pressure casting using molten aluminum, in order to prevent deformation due to a difference between shrinkage of aluminum and shrinkage of the saltcore, the shrinkage needs to have a value of about 1.2% or less similar to the shrinkage of aluminum.

Figure 11:
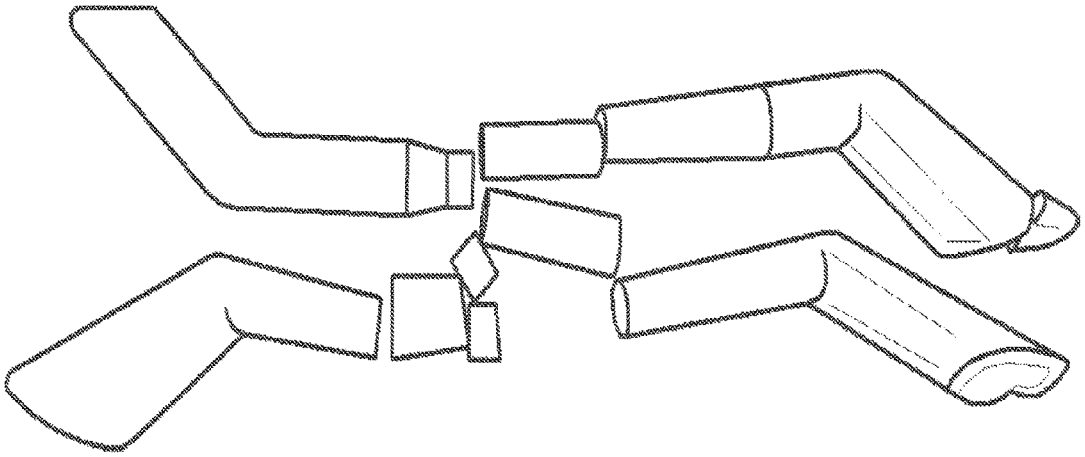
FIG. 11 is a photograph illustrating generation of cracks of the saltcore specimen in the related art.
Figure 12:
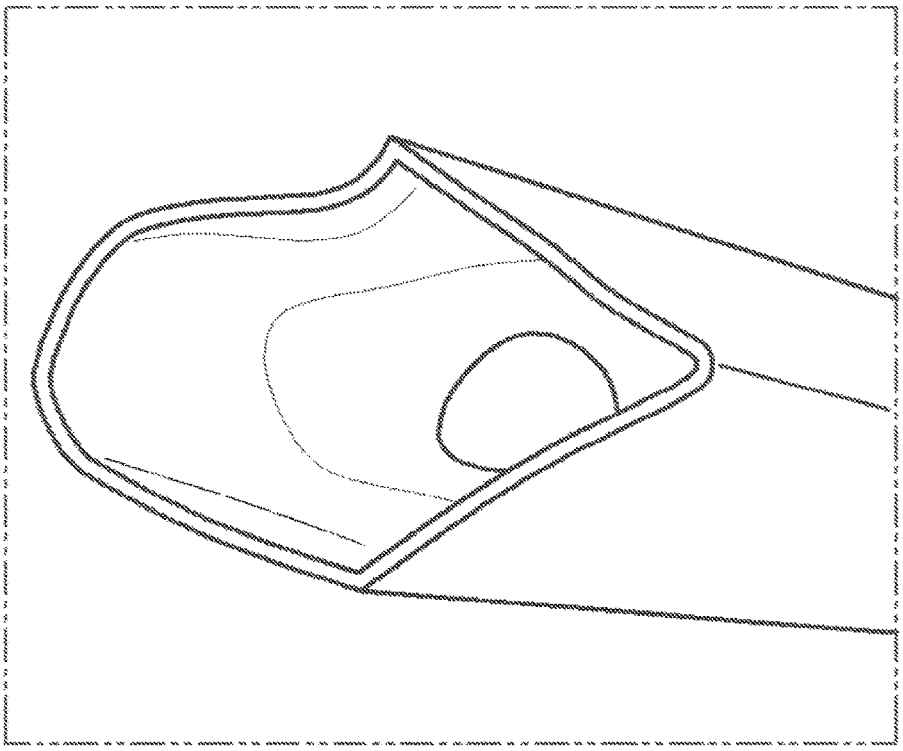
FIG. 12 is a photograph illustrating generation of cracks of the saltcore specimen in the related art.
Figure 13:
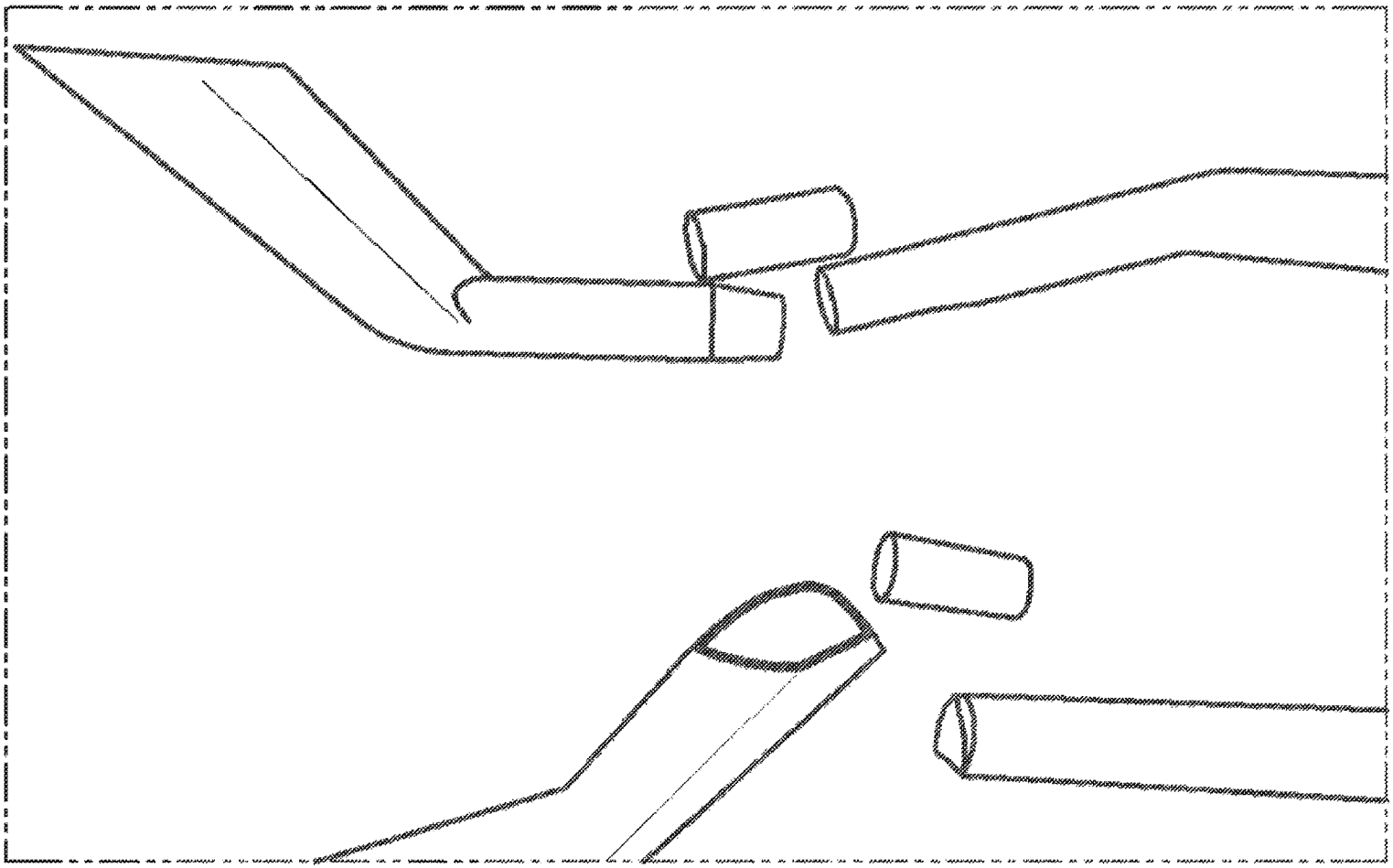
FIG. 13 is a photograph illustrating generation of cracks of the saltcore specimen in the related art.

When describing the Example and the Comparative Example in detail, in the case of preparing the saltcore with a composition in Comparative Examples 7 to 16, there is a problem in that cracks are generated in the saltcore specimen for measuring the strength and the saltcore specimen may not serve as the saltcore and the strength cannot be measured. FIGS. 11 to 13 are photographs illustrating generation of cracks of the saltcore specimen in the related art. As illustrated in FIGS. 11 to 13, it can be seen that the saltcore specimen for measuring the strength prepared according to the composition ratios of Comparative Examples 7 to 16 as the related art was broken.

It can be seen that the shrinkages of Comparative Examples 1 to 6 and Comparative Examples 17 to 21 exceed 1.2% and do not satisfy the shrinkage of the saltcore of the present invention. Further, in the Comparative Examples 4, 19 and 20, it can be seen that minimum strengths are smaller than 15 MPa and do not satisfy the strength of the saltcore of the present invention.

Figure 14:
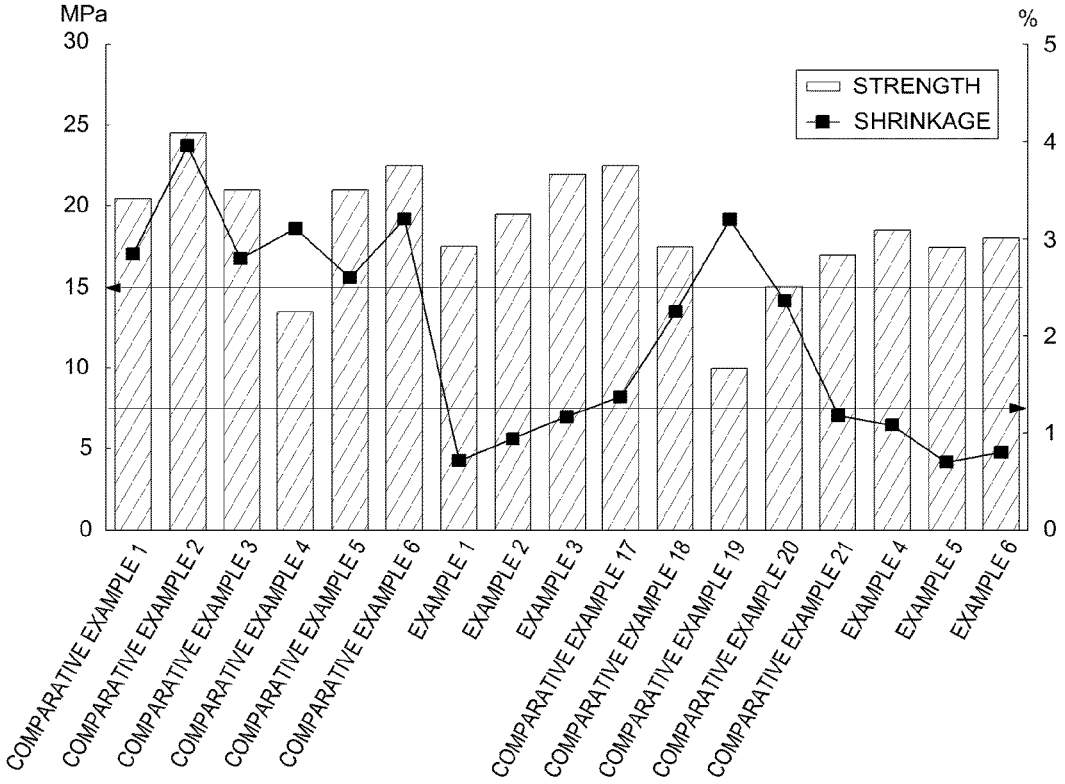
FIG. 14 is a graph illustrating both strength and shrinkage of the saltcore according to the related art and the exemplary embodiment of the present invention.

More particularly, the strengths and the shrinkages of the Examples and the Comparative Examples are illustrated in graphs in FIG. 14. FIG. 14 is a graph m illustrating both strengths and shrinkages of the saltcores according to the related art and the exemplary embodiment of the present invention. A vertical axis on the left side in the graph represents the strength and a unit corresponds to MPa. Further, a vertical axis on the right side in the graph represents the shrinkage, and a unit is %. Further, a bar graph in the graph represents the strength, and a line graph in the graph represents the shrinkage. In FIG. 14, the saltcore specimens for measuring the strength prepared according to the composition ratios of the Comparative Examples 7 to 16 as the related art were broken and the strengths may not be measured to be excluded from the Table.

As a result, as illustrated in FIG. 14, it can be seen that the saltcores satisfying the conditions of the shrinkage of about 1.2% or less and the strength of about 15 MPa are Examples 1 to 6 of the present invention.

Particularly, when describing the components related to the shrinkage of the saltcore of the present invention in detail, the amount corresponding to more than about 0 wt % and less than 1 wt % of dolomite, which is a compound having magnesium-based oxide or calcium-based oxide as a main component, with respect to the entire weight of the saltcore or more than 0 mol % and less than 1 mol % of $MgCl_2$ was added and then a test result is as follows.

The dolomite and $MgCl_2$serve to compensate for the shrinkage of the saltcore generated when the molten aluminum is solidified by forming micro bubbles in the saltcore by adding the dolomite and $MgCl_2$, and the effect of the micro bubbles increases to 1 wt % of the dolomite or 1 mol % of $MgCl_2$ according to an added amount. If the added amount is more than 1 wt % of the dolomite or 1 mol % or more of $MgCl_2$, micro bubbles in the saltcore are excessively generated, and the shrinkage of 1.2% is not satisfied by the expansion of the saltcore due to the excessive bubble effect.

Figure 15:
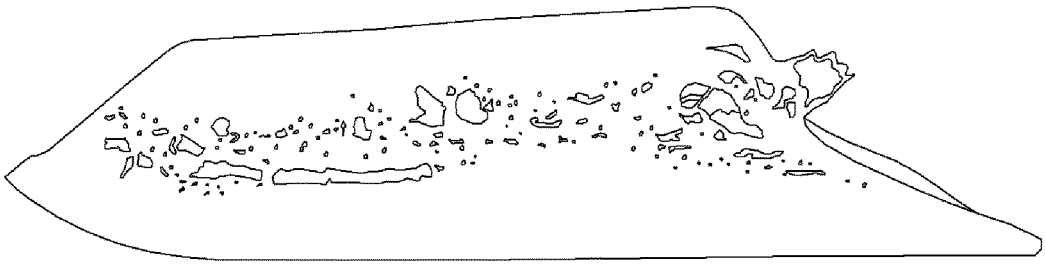
FIG. 15 is a photograph illustrating a cross section of a saltcore specimen containing 0.5 wt % of dolomite according to an exemplary embodiment of the present invention.
Figure 16:
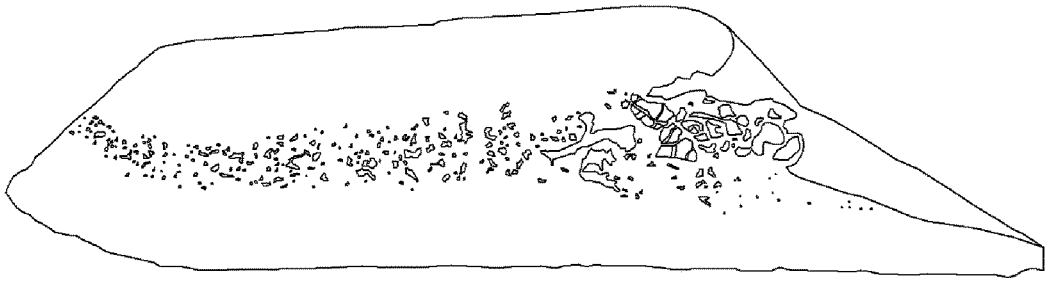
FIG. 16 is a photograph illustrating a cross section of a saltcore specimen containing 0.1 wt % of dolomite according to an exemplary embodiment of the present invention.

FIG. 15 is a photograph illustrating a cross section of a saltcore specimen containing 0.5 wt % of dolomite according to an exemplary embodiment of the present invention and FIG. 16 is a photograph illustrating a cross section of a saltcore specimen containing 0.1 wt % of dolomite according to an exemplary embodiment of the present invention. As illustrated in FIGS. 15 and 16, it can be verified that micro bubbles are generated by including dolomite in the saltcore. Also, it can be seen that the size of the micro bubbles increases as the added amount of dolomite increases.

Figure 17:
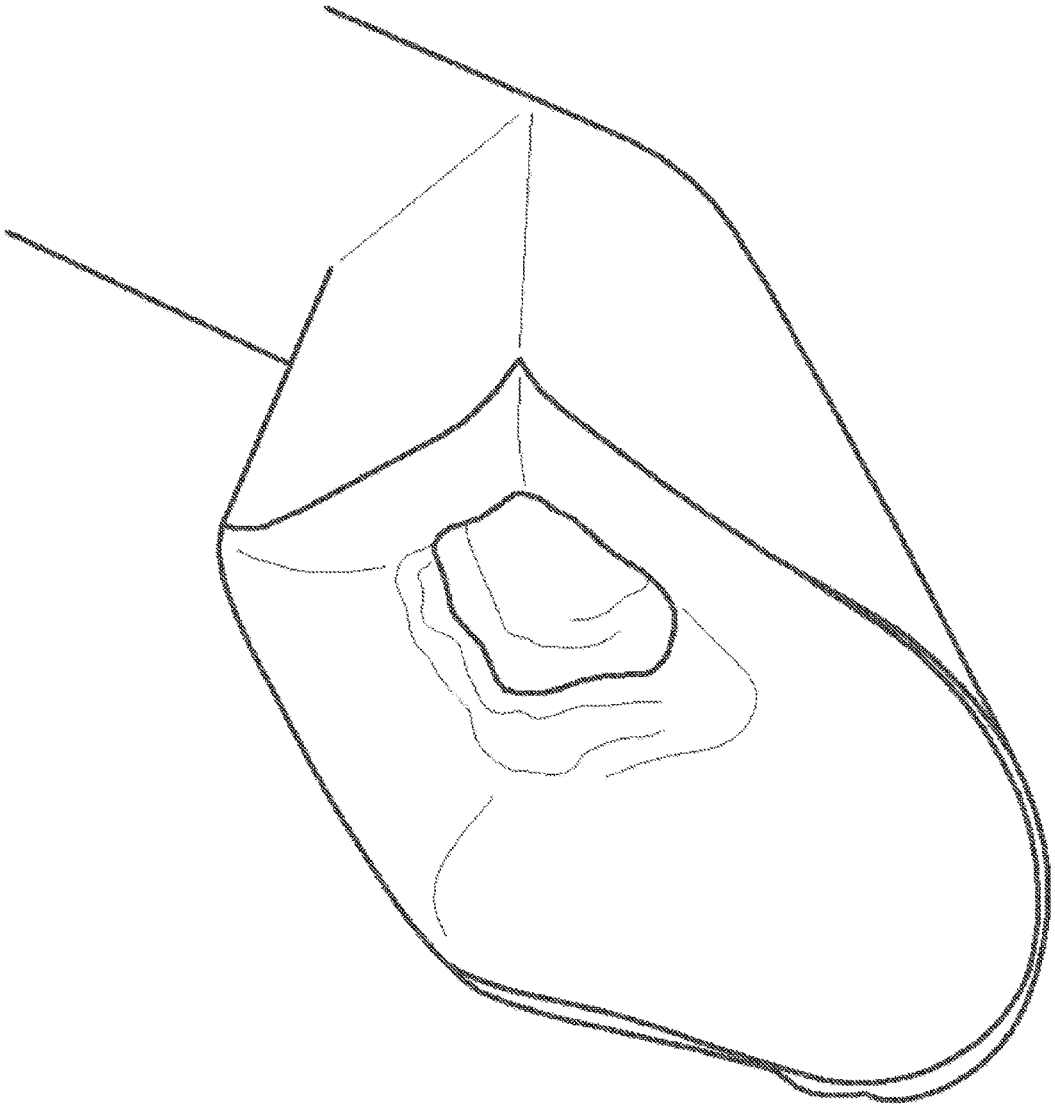
FIG. 17 is a photograph illustrating a saltcore specimen containing 0 wt % of dolomite in the related art.
Figure 18:
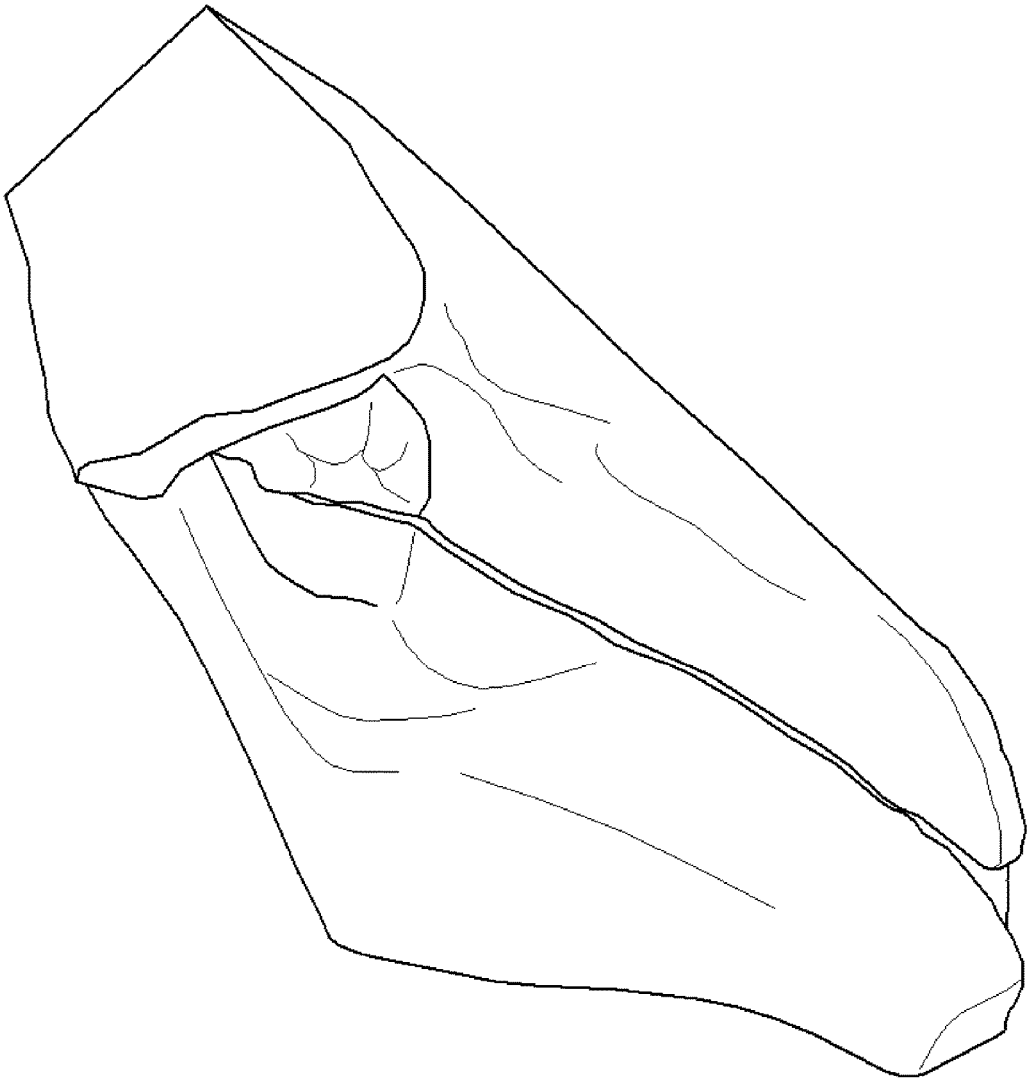
FIG. 18 is a photograph illustrating a saltcore specimen containing 0.1 wt % of dolomite according to an exemplary embodiment of the present invention.
Figure 19:
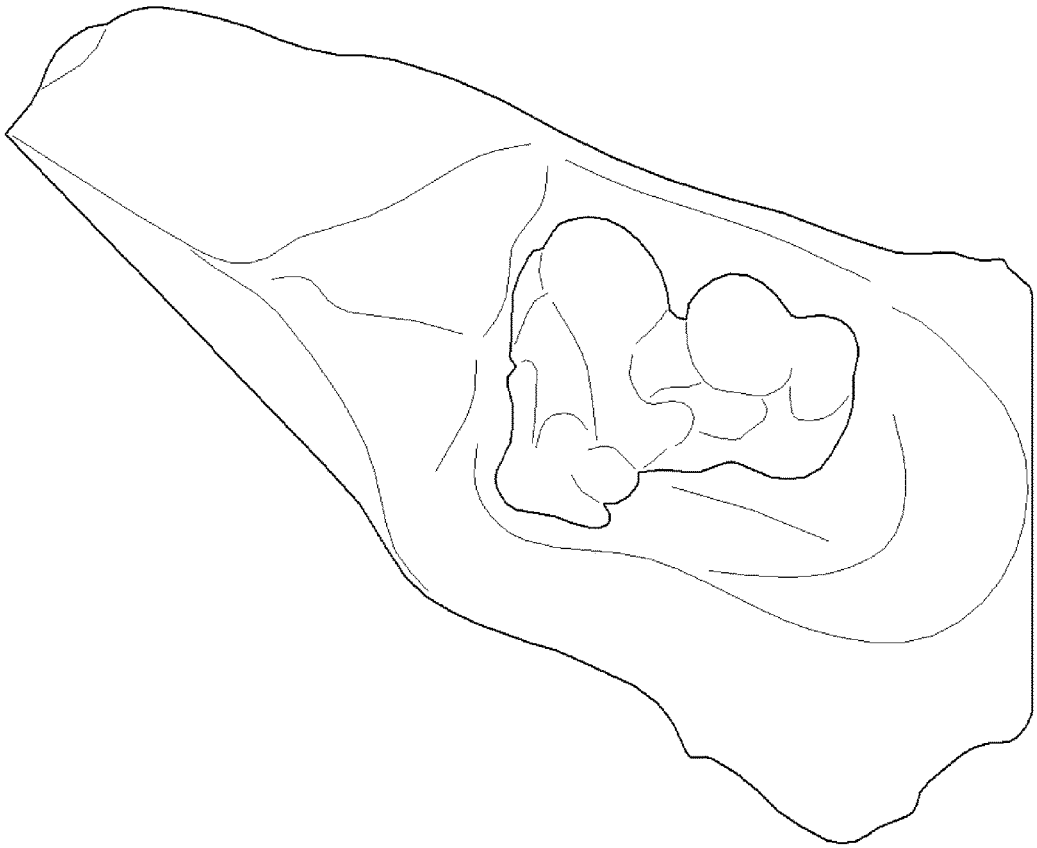
FIG. 19 is a photograph illustrating a saltcore specimen containing 0.5 wt % of dolomite according to an exemplary embodiment of the present invention.

FIG. 17 is a photograph illustrating a saltcore specimen containing more than 0 wt % of dolomite in the related art, FIG. 18 is a photograph illustrating a saltcore specimen containing 0.1 wt % of dolomite according to an exemplary embodiment of the present invention, and FIG. 19 is a photograph illustrating a saltcore specimen containing 0.5 wt % of dolomite according to an exemplary embodiment of the present invention. Unlike FIG. 17, as illustrated in FIGS. 18 and 19, it can be verified that the saltcore is expanded according to an added amount of the dolomite. In FIG. 17, it can be verified that dolomite is not added to the composition of the saltcore and thus a space is formed in the inside by shrinkage when preparing the saltcore. Further, in FIG. 18, it can be verified that when the saltcore is prepared by adding 0.1 wt % of the dolomite to the composition of the saltcore, micro bubbles are formed in the saltcore and thus an inner space is not formed. Furthermore, in FIG. 19, it can be verified that when 0.5 wt % of the dolomite is added to the composition of the saltcore, micro bubbles are increased in the saltcore when preparing the saltcore.

There is an advantage of obtaining effects of reducing cost and weight when gravity casting using a sand core in the related art is changed to a high-pressure casting method using a saltcore for casting with aluminum of the present invention. Specifically, it is required that the thickness of the cast article is at least 4 mm or more so as to manufacture an aluminum cast article by the gravity casting method, but when the high-pressure casting method using the saltcore for casting with aluminum of the present invention is applied, the thickness of the aluminum cast article may be prepared with 2 mm or less, and it is possible to obtain an effect of reducing a weight by about 5 to 8%.

In the case of applying the gravity casting method as the related art, a cycle time for producing a single cast article is about 600 seconds, but in the case of applying the high-pressure casting method using the saltcore for casting with aluminum of the present invention, the cycle time is reduced to about 60 seconds which is a level of 1/10 of the related art, and thus the cost is reduced by about 10 to 15%.

Figure 20:
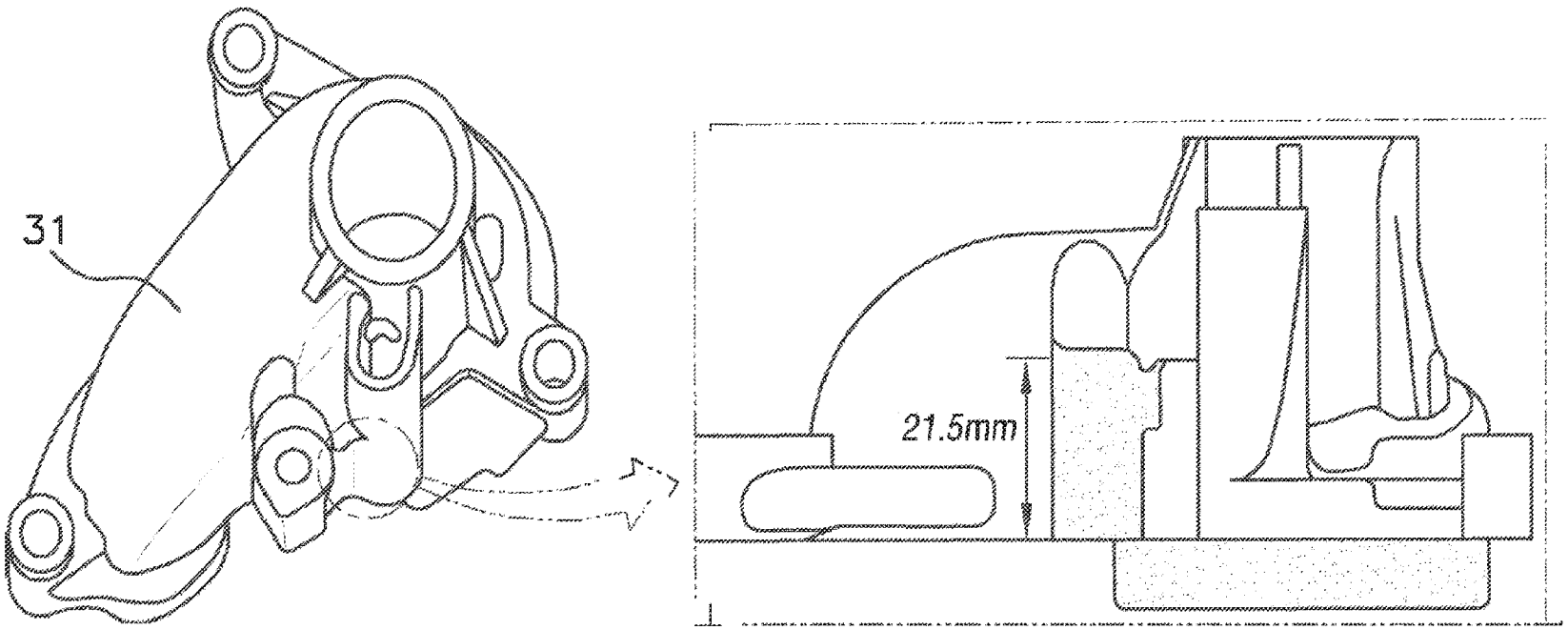
FIG. 20 is a configuration diagram and an enlarged configuration diagram of a water pump housing gravity-cast using a sand core in the related art.
Figure 21:
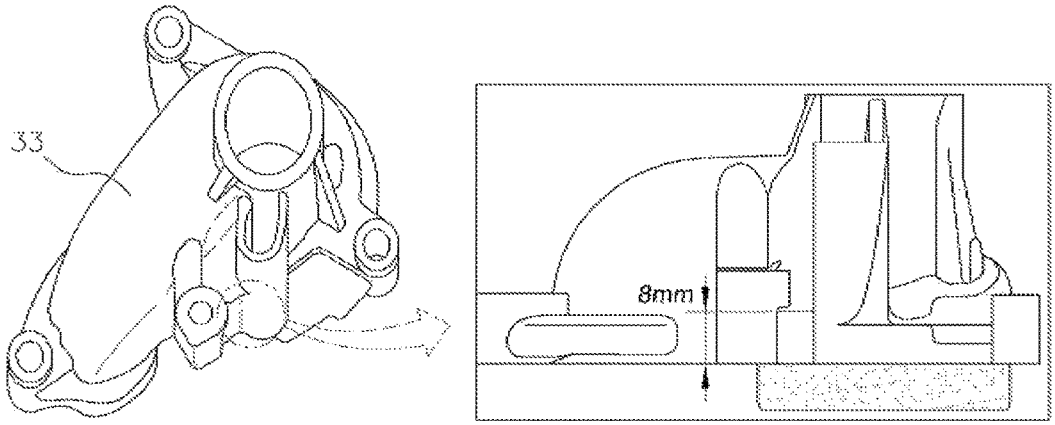
FIG. 21 is a configuration diagram and an enlarged configuration diagram of a housing high pressure-cast using the saltcore according to the exemplary embodiment of the present invention.

In detail, FIG. 20 is a configuration diagram and an enlarged configuration diagram of a water pump housing 31 which is gravity-cast using a sand core in the related art and FIG. 21 is a configuration diagram and an enlarged configuration diagram of a housing 33 which is high pressure-cast using the saltcore according to the exemplary embodiment of the present invention. When verifying an enlarged photograph of a water pump housing which is gravity-cast by using the sand core in the related art, it can be verified that the thickness of the cast article is 21.5 mm. However, it can be verified that the thickness of the housing which is high-pressure cast using the saltcore for casting with aluminum of the present invention is reduced to 8.0 mm and the thickness is reduced and the weight is reduced.

Figure 22:
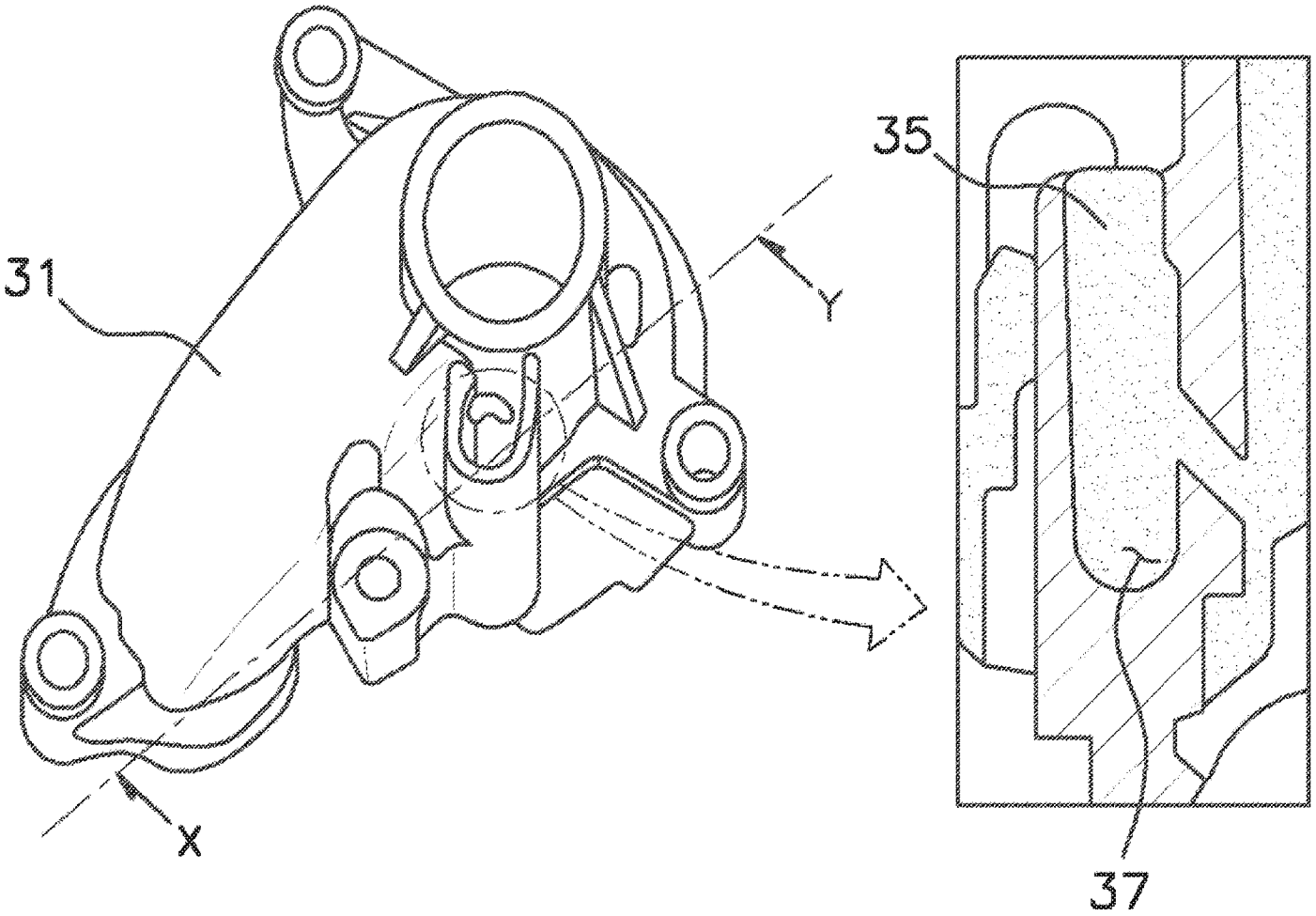
FIG. 22 is a configuration diagram and a cross-sectional enlarged configuration diagram of a water pump housing gravity-cast using a sand core in the related art.
Figure 23:
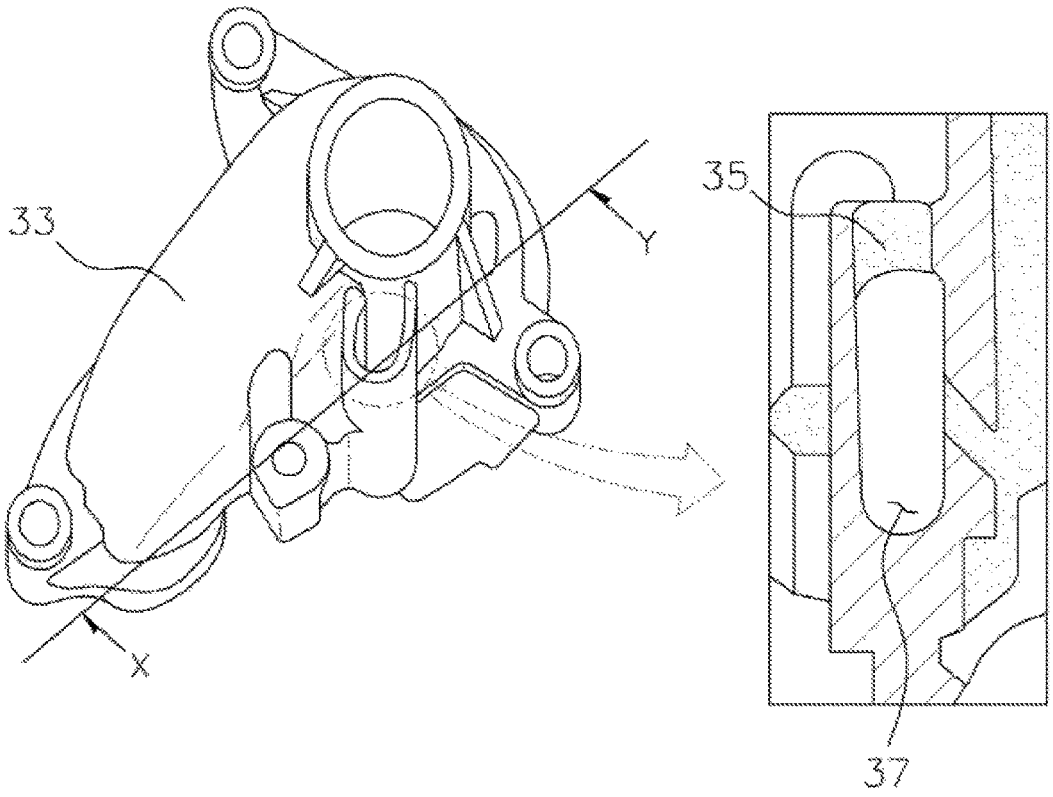
FIG. 23 is a configuration diagram and a cross-sectional enlarged configuration diagram of a housing high pressure-cast using the saltcore according to the exemplary embodiment of the present invention.

In detail, FIG. 22 is a configuration diagram and an enlarged configuration diagram of a water pump housing 31 which is gravity-cast using a sand core in the related art and FIG. 23 is a configuration diagram and a cross-sectional enlarged configuration diagram of a housing 33 which is high pressure-cast using the saltcore according to the exemplary embodiment of the present invention. When verifying cross sections of X-Y in FIGS. 22 and 23, there is a problem in that the water pump housing which is gravity-cast using the sand core as the related art is processed after casting a cam assembly portion 35 and a drain chamber portion 37, but the housing which is high-pressure cast using the saltcore for casting with aluminum of the present invention may be formed by a mold when high-pressure casting the cam assembly portion 35 and the drain chamber portion 37, and thus it is possible to reduce the cost due to reduction of a weight of 10% and reduction of the production process.

Figure 24:
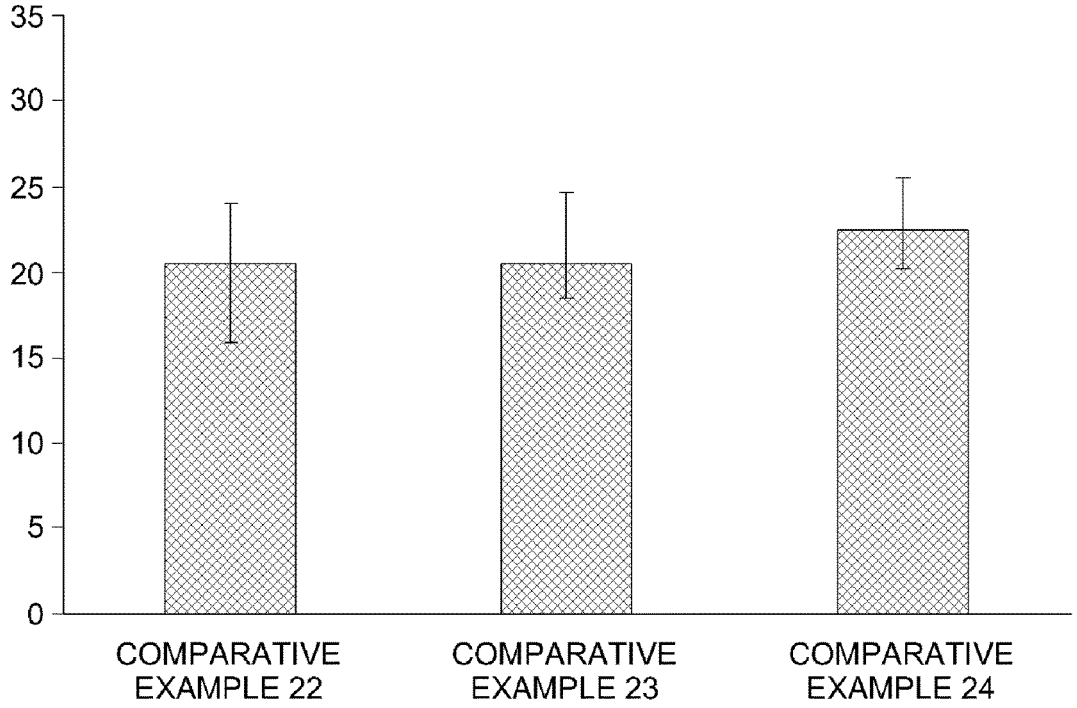
FIG. 24 is a graph illustrating strength of a saltcore containing 40 mol % of NaCl and 60 mol % of $Na_2CO_3$.

In the case where NaCl is included instead of KCl among components of the saltcore for casting with aluminum according to an exemplary embodiment of the present invention, problems will be described. After preparing Comparative Examples 22 to 24, which are three saltcores containing KCl as a component of the saltcore, the strengths were measured. FIG. 24 is a graph illustrating strength of a saltcore containing 40 mol % of KCl and 60 mol % of $Na_2CO_3$ and a unit is MPa. As illustrated in FIG. 24, it can be verified that when the KCl is included as the component of the saltcore, the strength of the saltcore is about 20 MPa or more.

Figure 25:
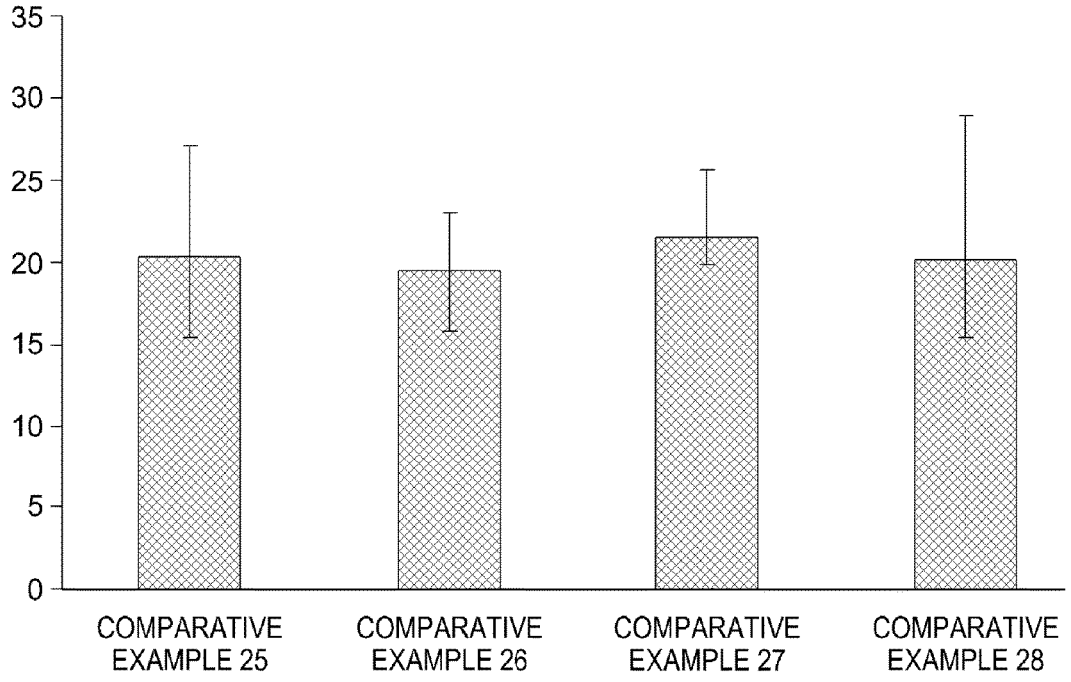
FIG. 25 is a graph illustrating strength of a saltcore containing 40 mol % of NaCl and 60 mol % of $Na_2CO_3$.
Figure 26:
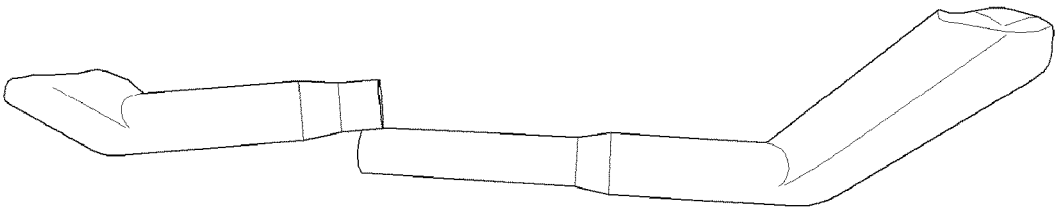
FIG. 26 is a photograph illustrating generated cracks of a saltcore containing 40 mol % of NaCl and 60 mol % of $Na_2CO_3$.

After preparing Comparative Examples 25 to 28, which are four saltcores containing NaCl as a component of the saltcore, the strengths were measured. FIG. 25 is a graph illustrating strength of a saltcore containing 40 mol % of NaCl and 60 mol % of $Na_2CO_3$ and a unit is MPa. As illustrated in FIG. 25, it can be verified that when the NaCl is included as the component of the saltcore, the strength of the saltcore is about 20 MPa or more and the strength is slightly improved as compared with the case where the KCl is included as the component of the saltcore. However, there is a problem in that the salt core containing NaCl is broken by generating cracks by shrinkage of 30% to 40% of the prepared saltcore. On the other hand, in the case of the saltcore containing KCl as the component of the salt core, the cracks are generated due to shrinkage only in the saltcore of less than 5% of the prepared saltcore. FIG. 26 is a photograph illustrating generated cracks of a saltcore containing 40 mol % of NaCl and 60 mol % of $Na_2CO_3$. As illustrated in FIG. 26, there are problems in that in the saltcore containing NaCl, cracks are excessively generated as compared with the saltcore containing KCl, and thus production cost increases and it is unsuitable for mass production. Accordingly, it can be verified that the occurrence of cracks due to shrinkage is reduced, and that KCl is preferably contained as a component of the saltcore having the strength of 20 MPa or more.

In the case of applying the saltcore for casting with aluminum of the present invention, a reverse gradient (undercut) shape can reduce weight and cost by using a high-pressure casting method. In more detail, the aluminum cast article including the reverse gradient shape has advantages of reducing a weight by about 10% of the weight of the cast article in the related art, reducing the thickness and the weight, and forming the shape applied to an actual component, by changing the gravity casting method or the low-pressure casting method in the related art to the high-pressure casting method to which the saltcore for casting with aluminum of the present invention is applied. Further, in the gravity casting method in the related art, about 600 seconds are required for producing the cast article, but according to an exemplary embodiment of the present invention, about 60 seconds are required and thus the cycle time is reduced and the cost is reduced by about 10 to 15%.

Figure 27:
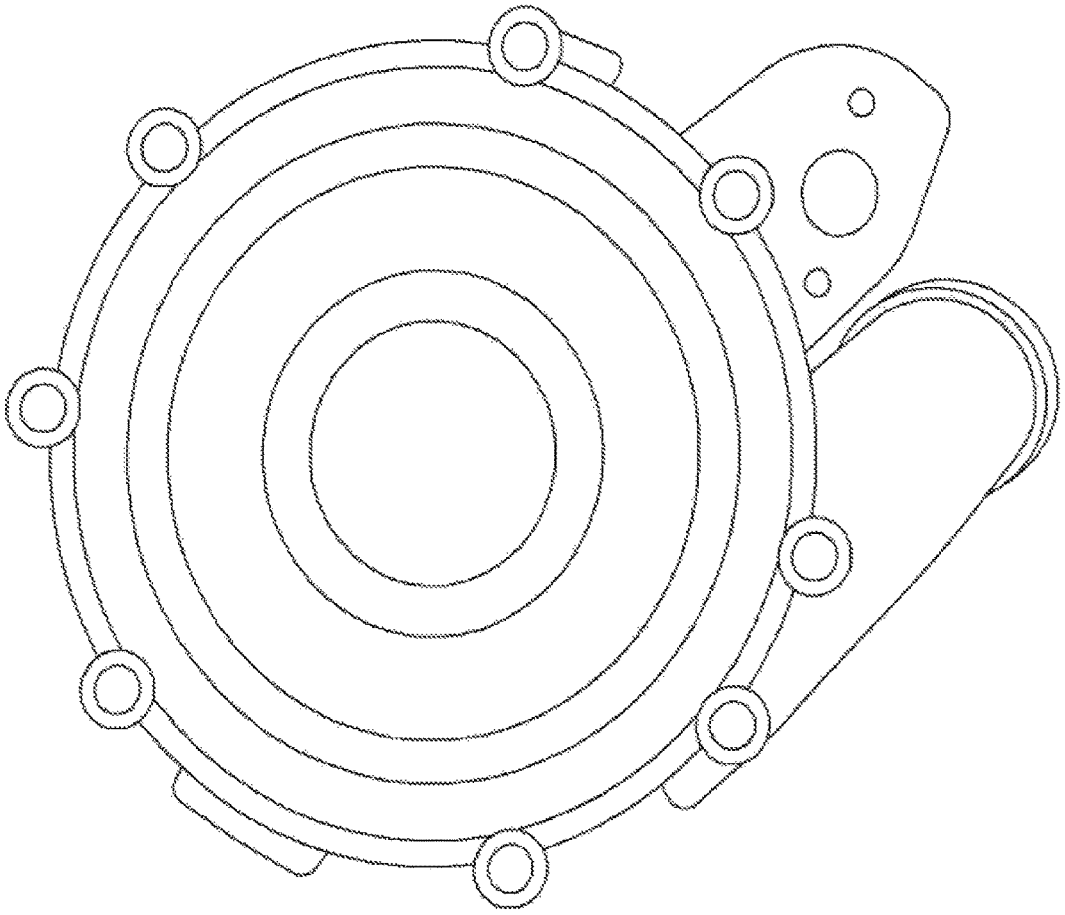
FIG. 27 is a photograph of a turbocharger compressor housing according to the exemplary embodiment of the present invention.
Figure 28:
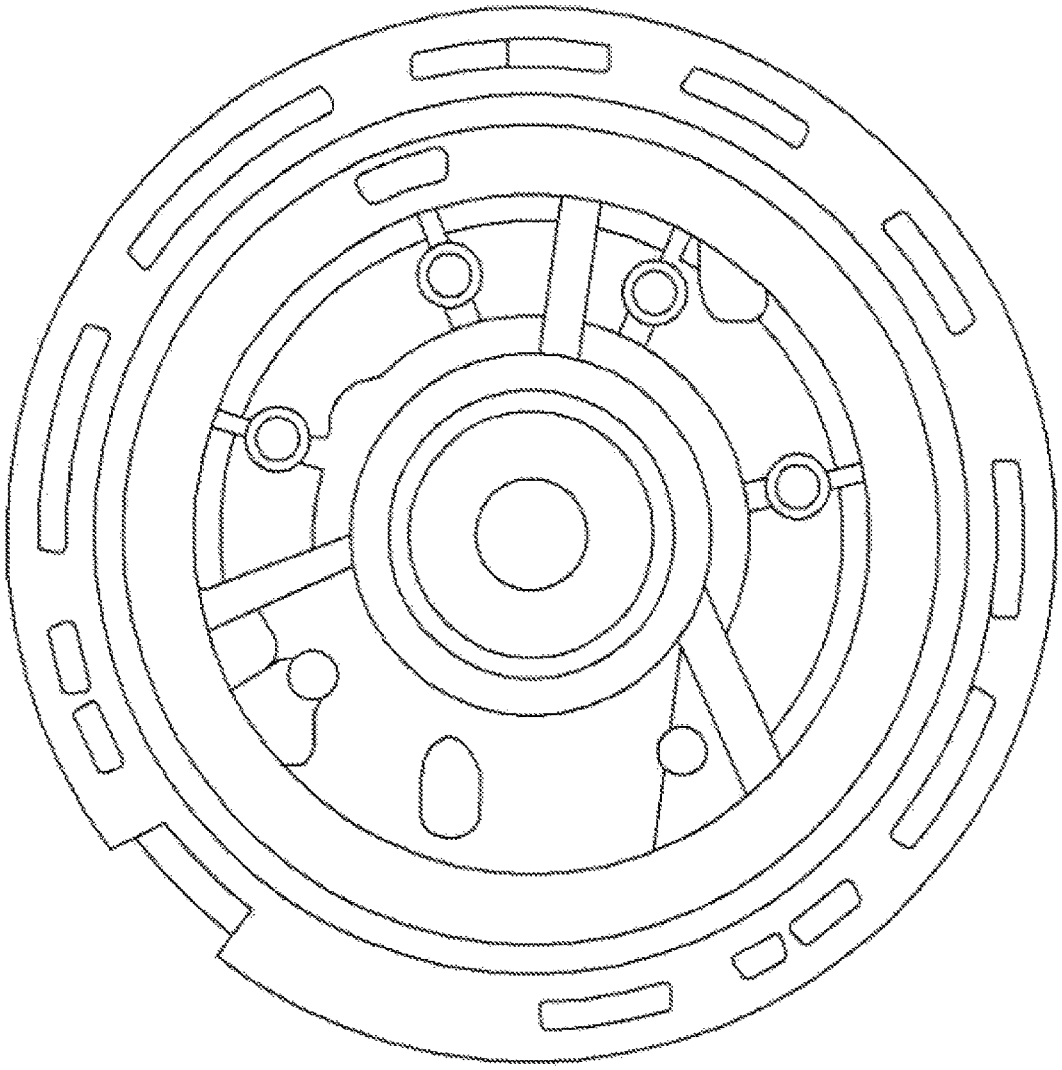
FIG. 28 is a photograph of a rear-wheel transmission oil pump cover according to the exemplary embodiment of the present invention.
Figure 29:
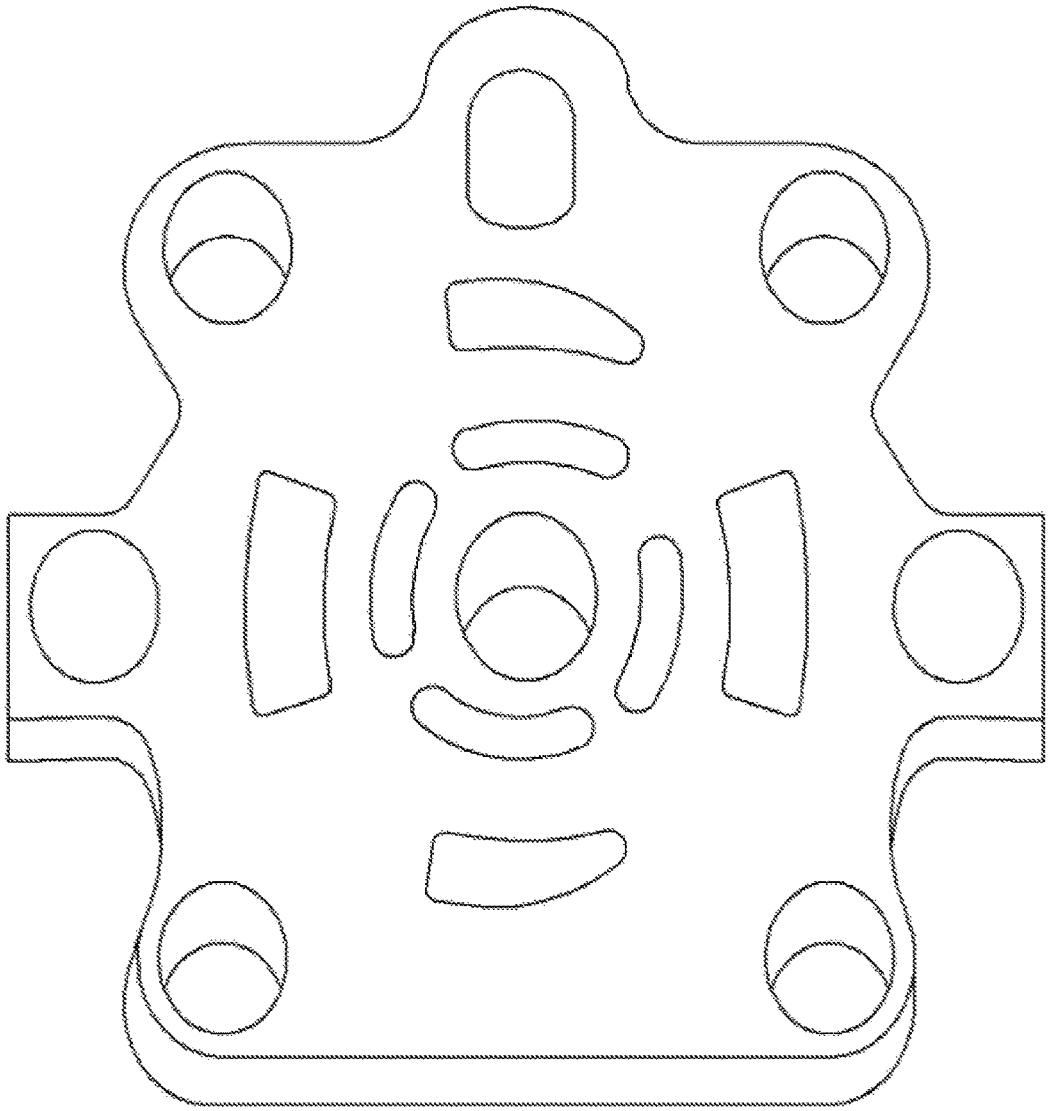
FIG. 29 is a photograph of an air conditioner compressor rear cover according to the exemplary embodiment of the present invention.
Figure 30:
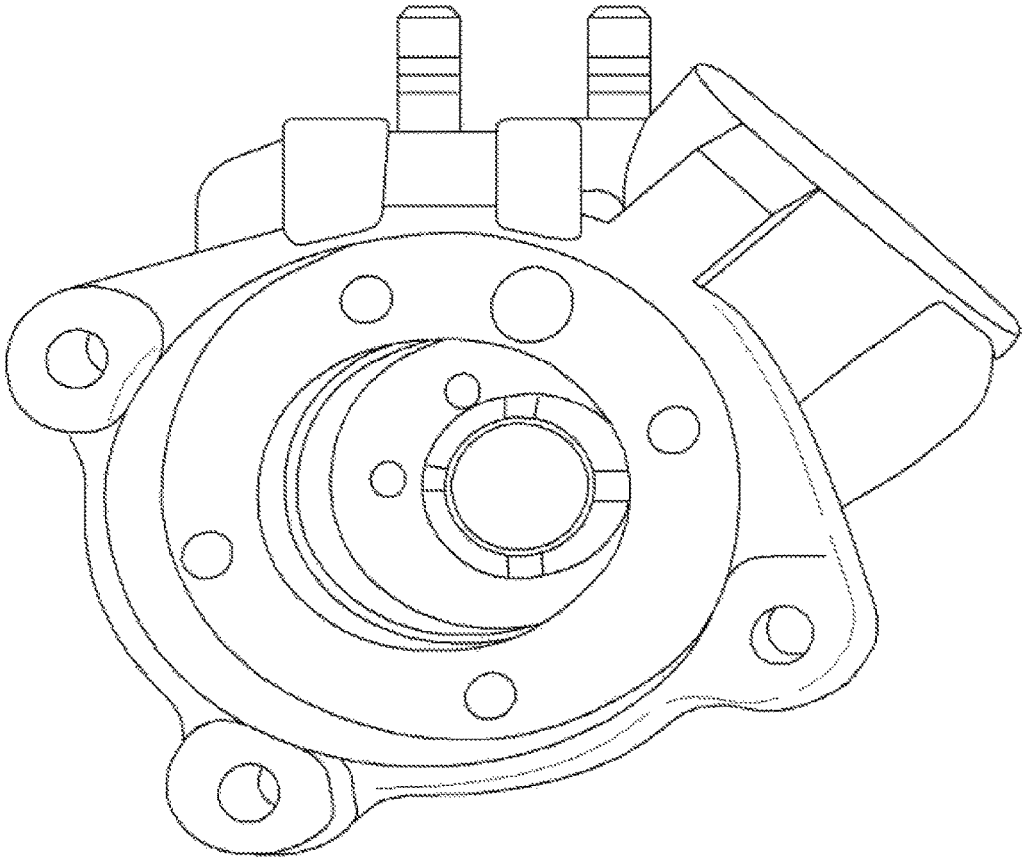
FIG. 30 is a photograph of a diesel high-pressure pump housing according to the exemplary embodiment of the present invention.
Figure 31:
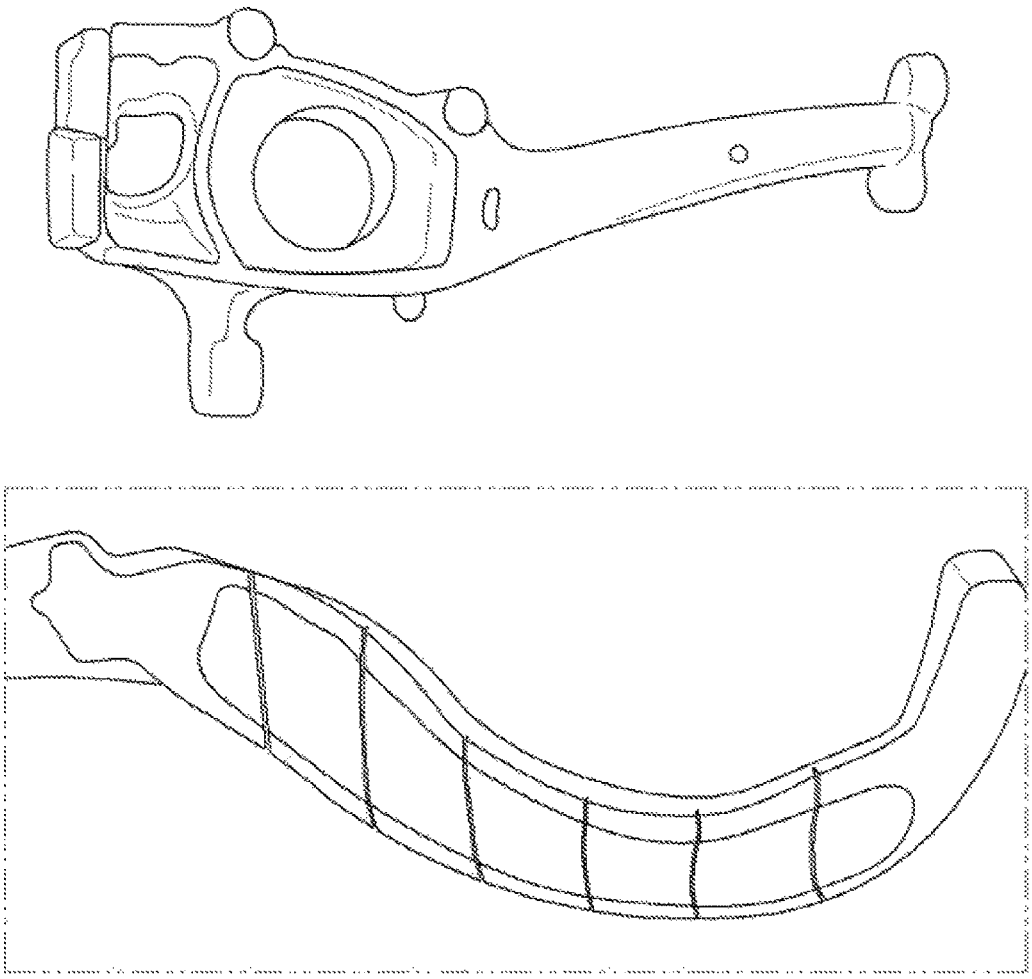
FIG. 31 is a photograph of a hollow front knuckle according to the exemplary embodiment of the present invention.
Figure 32:
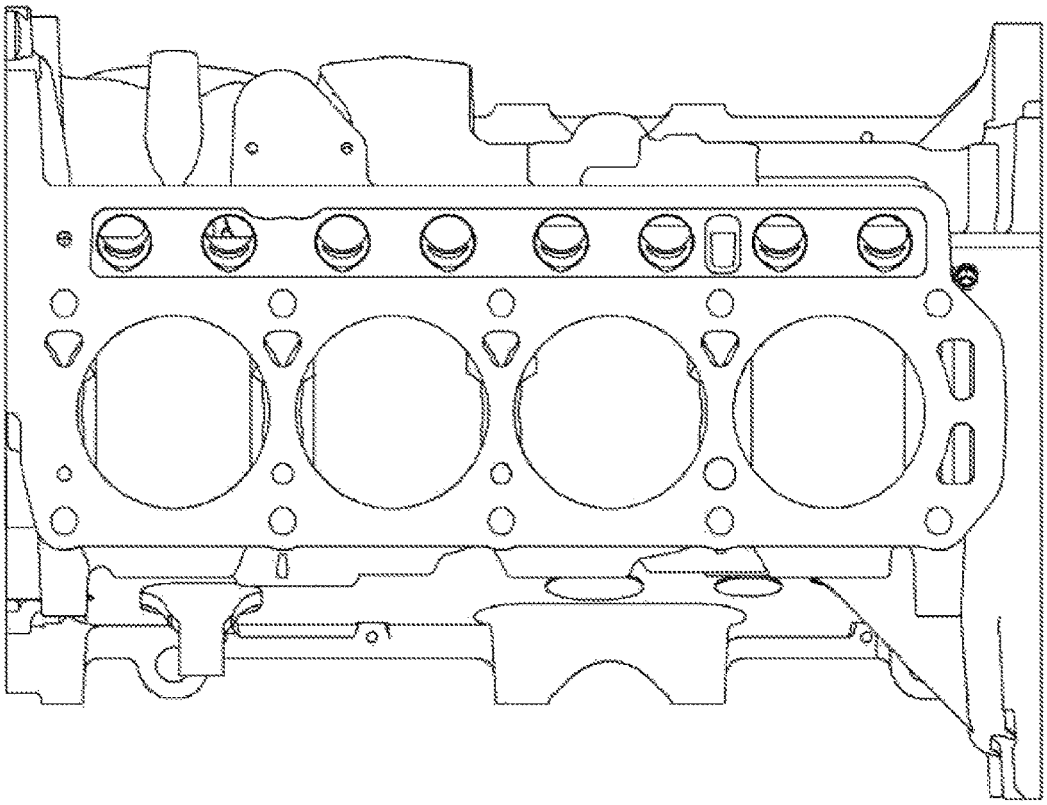
FIG. 32 is a photograph of a closed deck cylinder block according to the exemplary embodiment of the present invention.
Figure 33:
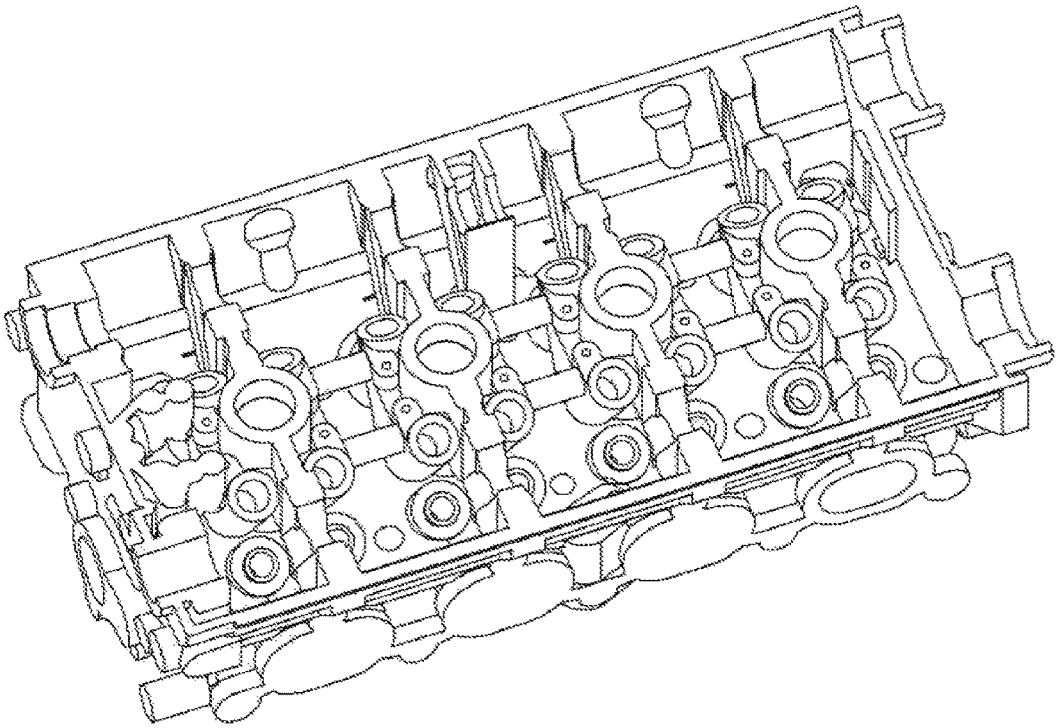
FIG. 33 is a photograph of a cylinder head according to the exemplary embodiment of the present invention.

According to the saltcore for casting with aluminum of the present invention, applicable components can be diversified. More particularly, FIG. 27 is a photograph of a turbocharger compressor housing according to the exemplary embodiment of the present invention, FIG. 28 is a photograph of a rear-wheel transmission oil pump cover according to the exemplary embodiment of the present invention, and FIG. 29 is a photograph of an air conditioner compressor rear cover according to the exemplary embodiment of the present invention. Further, FIG. 30 is a photograph of a diesel high-pressure pump housing according to the exemplary embodiment of the present invention, FIG. 31 is a photograph of a hollow front knuckle according to the exemplary embodiment of the present invention, and FIG. 32 is a photograph of a closed deck cylinder block according to the exemplary embodiment of the present invention. Further, FIG. 33 is a photograph of a cylinder head according to the exemplary embodiment of the present invention. As illustrated in FIGS. 27 to 34, there is an advantage of forming an aluminum cast article having a complicated configuration by using the saltcore for casting with aluminum of the present invention.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A saltcore for casting with aluminum, said saltcore comprising: at least one cation of $K^+$, $Na^+$ and $Mg^{2+}$ and at least one anion of $Cl^-$ and $CO_3^{2-}$, wherein $Mg^{2+}$ is essentially included therein at more than 0.1 part by mol.

2. The saltcore for casting with aluminum of claim 1, wherein the $K^+$ is 35 to 40 mol, the $Na^+$ is 110 to 130 part by mol, and the $Mg^{2+}$ is more than 0.1 part by mol and less than 1 part by mol, the $Cl^-$ is more than 35 part by mol and less than 42 part by mol, and the $CO_3^{2-}$ is 55 to 65 part by mol.

3. The saltcore for casting with aluminum of claim 1, wherein the $K^+$ or $Mg^{2+}$ is bonded to the $Cl^-$, and the $Na^+$ is bonded to the $CO_3^{2-}$.

4. The saltcore for casting with aluminum of claim 3, wherein the KCl is 35 to 40 part by mol, the $Na_2CO_3$ is 55 to 65 part by mol, and the $MgCl_2$ is more than 0 part by mol and less than 1 part by mol.

5. The saltcore for casting with aluminum of claim 1, the saltcore comprising cations of $K^+$, $Na^+$ and $Mg^{2+}$, and anions of $Cl^-$ and $CO_3^{2-}$.

6. A saltcore for casting with aluminum, said saltcore comprising:

at least one cation of $K^+$ and $Na^+$, at least one anion of $Cl^-$ and $CO_3^{2-}$, and dolomite, wherein the $K^+$ is 35 to 40 part by mol or the $Na^+$ is 110 to 130 part by mol, and the $Cl^-$ is 35 to 40 part by mol or the $CO_3^{2-}$ is 55 to 65 part by mol, and the dolomite is more than 0 wt % and less than 1 wt % with respect to the entire weight.

7. The saltcore for casting with aluminum of claim 6, wherein the $K^+$ is bonded to the $Cl^-$, and the $Na^+$ is bonded to the $CO_3^{2-}$.

8. The saltcore for casting with aluminum of claim 7, wherein the KCl is 35 to 40 part by mol, the $Na_2CO_3$ is 55 to 65 part by mol, and the dolomite is more than 0 wt % and less than 1 wt % with respect to the entire weight.

9. A saltcore for casting with aluminum, said saltcore comprising at least of one of NaCl, KCl, $Na_2CO_3$, and $CaCl_2$, in combination with at least one of $MgCl_2$ and dolomite, wherein the shrinkage of the saltcore is 1.2% or less.

* * * * *